US012686476B2

(12) United States Patent
Oorebeek et al.

(10) Patent No.: US 12,686,476 B2
(45) Date of Patent: Jul. 21, 2026

(54) SELF-DEPLOYING AERODYNAMIC SYSTEM

(71) Applicant: Joseph Mark Oorebeek, Mountain View, CA (US)

(72) Inventors: Joseph Mark Oorebeek, Palo Alto, CA (US); Arpan V. Rau, Mountain View, CA (US); Bailey Kathleen Seamount Da Costa, Mountain View, CA (US)

(73) Assignee: Joseph Oorebeek, Mountain View, CA (US)

( * ) Notice: Subject to any disclaimer, the term of this patent is extended or adjusted under 35 U.S.C. 154(b) by 302 days.

(21) Appl. No.: 18/617,327

(22) Filed: Mar. 26, 2024

(65) Prior Publication Data

US 2024/0326968 A1 Oct. 3, 2024

Related U.S. Application Data

(60) Provisional application No. 63/456,474, filed on Apr. 1, 2023.

(51) Int. Cl.

| | |
|---|---|
| ***B63H 9/061*** | (2020.01) |
| ***B63H 9/10*** | (2006.01) |
| ***B63J 3/00*** | (2006.01) |

(52) U.S. Cl.

CPC ..... *B63H 9/061* (2020.02); *B63H 9/1092* (2013.01); *B63J 3/00* (2013.01); *B63J 2003/002* (2013.01)

(58) Field of Classification Search

CPC . B63H 9/00; B63H 9/06; B63H 9/061; B63H 9/08; B63H 9/1092; B63J 3/00; B63J 2003/002

(Continued)

(56) References Cited

U.S. PATENT DOCUMENTS 6,431,100 B2 * 8/2002 Abshier ..... B63H 9/1021 114/102.22
8,117,978 B2 * 2/2012 Ouchi ..... B63H 9/1021 114/104

(Continued)

FOREIGN PATENT DOCUMENTS

CN 2507777 Y * 8/2002 ..... B63H 9/0628
CN 104085521 A * 10/2014 ..... B63H 9/1042

(Continued)

*Primary Examiner* — Frederick L Lagman

(74) *Attorney, Agent, or Firm* — Cognition IP, P.C.; Edward Steakley; Justin White

(57) ABSTRACT

A system configured to self-deploy an aerodynamic structure can include an outer container, load transfer components, the aerodynamic structure, and conversion devices. The outer container can have a standardized form factor and can store the aerodynamic structure therein and deploy the aerodynamic structure therefrom. The load transfer components can transfer propulsion loads from the system to a shipping vehicle. The aerodynamic structure can include wind capturing components that convert wind forces to propulsion loads and structural components that stabilize and space apart the wind capturing components. The aerodynamic structure can be deployed to an extended configuration outside the outer container and be retracted to a stored configuration within the outer container. The conversion devices can deploy the aerodynamic structure from the stored configuration to the extended configuration and retract the aerodynamic structure from the extended configuration to the stored configuration while the system is removably installed on the shipping vehicle.

20 Claims, 15 Drawing Sheets

(58) Field of Classification Search
USPC ..... 114/102.15
See application file for complete search history.

(56) References Cited

U.S. PATENT DOCUMENTS

| | | | | |
|---|---|---|---|---|
| 9,376,187 | B2 * | 6/2016 | Atkinson | B63H 9/1092 |
| 2017/0158299 | A1 * | 6/2017 | Saiz | B63H 9/072 |
| 2019/0263493 | A1 * | 8/2019 | Johnson | B63H 9/06 |
| 2025/0136257 | A1 * | 5/2025 | De Turckheim | B63H 9/061 |

FOREIGN PATENT DOCUMENTS

| | | | | | |
|---|---|---|---|---|---|
| CN | 104118551 | B | * | 2/2017 | B63H 9/061 |
| CN | 109937173 | A | * | 6/2019 | B63B 15/00 |
| CN | 113353225 | A | * | 9/2021 | H02J 7/35 |
| CN | 115503922 | A | * | 12/2022 | B63H 9/0628 |
| CN | 118660844 | A | * | 9/2024 | B63H 9/1092 |
| CN | 118786074 | A | * | 10/2024 | B63H 9/1092 |
| CN | 120569325 | A | * | 8/2025 | B63H 9/061 |
| DE | 102019005436 | A1 | * | 2/2021 | B63H 9/1092 |
| KR | 20240127445 | A | * | 8/2024 | B63H 9/1092 |
| WO | WO-2015107291 | A1 | * | 7/2015 | B63H 9/1092 |
| WO | WO-2018068155 | A2 | * | 4/2018 | B63H 21/20 |
| WO | WO-2020219387 | A1 | * | 10/2020 | B65D 90/00 |

* cited by examiner

SELF-DEPLOYING AERODYNAMIC SYSTEM

CROSS-REFERENCE TO RELATED APPLICATION

This application claims priority to U.S. Provisional Patent Application No. 63/456,474, filed Apr. 1, 2023, and titled "SELF-DEPLOYING AERODYNAMIC SYSTEM," which is incorporated herein by reference in its entirety.

TECHNICAL FIELD

The present disclosure relates generally to aerodynamic devices and systems, and more particularly to improved aerodynamic systems for wind propulsion of vehicles.

BACKGROUND

Shipping physical materials and items across the world is collectively a multi-trillion dollar industry. For example, the container shipping industry involves moving large shipping containers across the oceans and railroads of the world. This industry specifically has experienced difficulties in recent years due to various factors, some of which include the increasing fuel costs needed to operate cargo ships, trains, and other vehicles used to transport shipping containers over both oceans and land. In addition to these increasing fuel costs, the burning of fuel to move shipping containers also results in enormous emissions of pollutants and greenhouse gases into the environment around the world.

Unfortunately, the overall worldwide shipping industry has not done enough to use other forms of energy to ship physical materials and items and still relies overwhelmingly on burning fossil fuels in many forms of shipping. While some progress has been made in using electrical and other alternative forms of energy to propel ships, trains, cars, and other vehicles, such as improved sailboats for harnessing wind energy, for example, such efforts have generally not translated into shipping applications, and in particular the container shipping industry.

Although traditional ways of propelling cargo ships and other vehicles have worked in the past, improvements are always helpful. In particular, what is desired are improved aerodynamic systems for wind-aided propulsion of cargo ships and other vehicles.

SUMMARY

It is an advantage of the present disclosure to provide improved aerodynamic systems for wind-aided propulsion of cargo ships and other vehicles. The disclosed features, apparatuses, systems, and methods relate to self-deploying aerodynamic systems, and in particular systems and devices configured to self-deploy an aerodynamic structure that can facilitate the wind-aided propulsion of a cargo ship or other shipping container bearing vehicle. This can be accomplished at least in part by using an aerodynamic structure that can be automatically deployed from and stored into a container having a standardized form factor that couples to shipping containers.

In various embodiments of the present disclosure, a system configured to self-deploy an aerodynamic structure can include at least an outer container, one or more load transfer components, the aerodynamic structure itself, and one or more conversion devices. The outer container, which can have a standardized form factor, can be configured to store the aerodynamic structure therein and deploy the aerodynamic structure therefrom. The one or more load transfer components can be located proximate the outer container and can be configured to transfer propulsion loads from the system to a movable shipping vehicle. The aerodynamic structure can include one or more wind capturing components configured to convert outside wind forces to propulsion loads and one or more structural components configured to stabilize and space apart the one or more wind capturing components. The aerodynamic structure can be configured to be deployed to an extended configuration outside the outer container and to be retracted to a stored configuration within the outer container. The one or more conversion devices can be configured both to deploy automatically the aerodynamic structure from the stored configuration to the extended configuration and to retract automatically the aerodynamic structure from the extended configuration to the stored configuration while the overall system is removably installed on the movable shipping vehicle.

In various detailed embodiments, the standardized form factor of the outer container can correspond to the size or footprint of one or more standard cargo shipping containers. As such, the system can be configured to be removably installed directly atop and coupled to one or more stacks of multiple standard cargo shipping containers located on a top deck of the movable shipping vehicle. In various arrangements, the one or more wind capturing components can include multiple vertically oriented tape-springs arranged into the shape of a vertically oriented enclosed wingsail, while the one or more structural components can include multiple horizontally oriented ribs located within and spaced apart from the top to the bottom of the vertically oriented enclosed wingsail when the aerodynamic structure is in the extended configuration. Each of the multiple vertically oriented tape-springs can be formed from a metallic material having a thickness of about 2 mm. The vertically oriented enclosed wingsail can have a height of about 60 meters, a length of about 8 meters, and a width of about 2 meters, and the spacing between each of the horizontally oriented ribs can be about 2 meters when the aerodynamic structure is in the extended configuration. The one or more structural components can also include one or more vertically arranged spars located between, extending through, and configured to facilitate the spacing of the multiple horizontally oriented ribs when the aerodynamic structure is in the extended configuration. The one or more conversion devices can include a spooling arrangement for each of the one or more wind capturing components, and each spooling arrangement can have a rotating drum configured to wrap a wind capturing component thereabout when the aerodynamic structure is in the stored configuration.

In various further detailed embodiments, the system can further include a top plate located across and covering a top opening of the outer container at a top plate storage position when the aerodynamic structure is in the stored configuration inside the outer container. This top plate can be configured to elevate from the top plate storage position to a top plate extended position when the aerodynamic structure is in the extended configuration. The system can also include a bottom plate located proximate the bottom of the outer container at a bottom plate storage position when the aerodynamic structure is in the stored configuration inside the outer container. This bottom plate can be configured to elevate from the bottom plate storage position to a bottom plate extended position proximate the top opening of the storage container when the aerodynamic structure is in the extended configuration. The top plate can include one or more features configured to guide the extension and the retraction of the one or more wind capturing components. In various arrangements, the system can also include a rotational bearing coupling the aerodynamic structure to the outer container. This rotational bearing can be configured to facilitate rotation of the aerodynamic structure about a vertical axis relative to the outer container when the aerodynamic structure is in the extended configuration. The system can also include one or more motors coupled to and configured to facilitate the automated operation of the one or more conversion devices, as well as one or more rechargeable batteries coupled to and configured to provide power to the one or more motors. The one or more motors and/or the one or more rechargeable batteries can be located within the outer container.

In various further embodiments of the present disclosure, methods of using an aerodynamic structure on a movable shipping vehicle are provided. Pertinent process steps can include deploying an aerodynamic structure, converting wind forces to propulsion loads, transferring the propulsion loads, and retracting the aerodynamic structure. Some or all process steps can be automatically performed. Deploying can involve deploying a stored aerodynamic structure from within an outer container of a self-deploying aerodynamic system to form an extended aerodynamic structure while the self-deploying aerodynamic system is installed onto the movable shipping vehicle. Converting can involve converting outside wind forces to propulsion loads using the extended aerodynamic structure. Transferring can involve transferring the propulsion loads from the self-deploying aerodynamic system to the movable shipping vehicle, and these propulsion loads can then be used to at least partially propel the movable shipping vehicle. Retracting can involve retracting the extended aerodynamic structure into the outer container of the self-deploying aerodynamic system to reform the stored aerodynamic structure.

In various detailed embodiments, the extended aerodynamic structure can include multiple vertically oriented tape-springs arranged into the shape of a vertically oriented enclosed wingsail and multiple horizontally oriented ribs located within and spaced apart from the top to the bottom of the vertically oriented enclosed wingsail. An additional process step can involve rotating automatically the extended aerodynamic structure about a vertical axis relative to the outer container from a first rotational position to a second rotational position. Such rotating to the second rotational position can result in improved conversion of the outside wind forces to propulsion loads. Further process steps can include forming the stored aerodynamic structure within the outer container of the self-deploying aerodynamic system, storing the stored aerodynamic structure within the outer container of the self-deploying aerodynamic system, installing the self-deploying aerodynamic system onto one or more standard cargo shipping containers located on the movable shipping vehicle, coupling one or more load transfer components of the self-deploying aerodynamic system to one or more load receiving components located on the movable shipping vehicle, and coordinating the deploying and retracting of the aerodynamic structure with the use of one or more separate aerodynamic structures on the movable shipping vehicle.

In still further embodiments of the present disclosure, a system configured to facilitate propulsion of a cargo ship can include a plurality of self-deployable aerodynamic structure subsystems and at least one processor in communication with and configured to facilitate the operational coordination of each of the plurality of self-deployable aerodynamic structure subsystems. Each self-deployable aerodynamic structure subsystem can include a deployable and retractable aerodynamic structure and can be configured to be removably installed atop and coupled to one or more standard cargo shipping containers located on the cargo ship. In various arrangements, each subsystem can also include an outer container, one or more load transfer components, the aerodynamic structure itself, and one or more conversion devices, some or all of which can have the same features and details as in the single system recited above. The at least one processor can be configured to facilitate the automated deploying, rotating, retracting, and storing the aerodynamic structure of each of the plurality of self-deployable aerodynamic structure subsystems.

Other apparatuses, methods, features, and advantages of the disclosure will be or will become apparent to one with skill in the art upon examination of the following figures and detailed description. It is intended that all such additional apparatuses, methods, features and advantages be included within this description, be within the scope of the disclosure, and be protected by the accompanying claims.

BRIEF DESCRIPTION OF THE DRAWINGS

The included drawings are for illustrative purposes and serve only to provide examples of possible structures, arrangements, and methods for self-deploying aerodynamic systems. These drawings in no way limit any changes in form and detail that may be made to the disclosure by one skilled in the art without departing from the spirit and scope of the disclosure.

DETAILED DESCRIPTION

Figure 1:
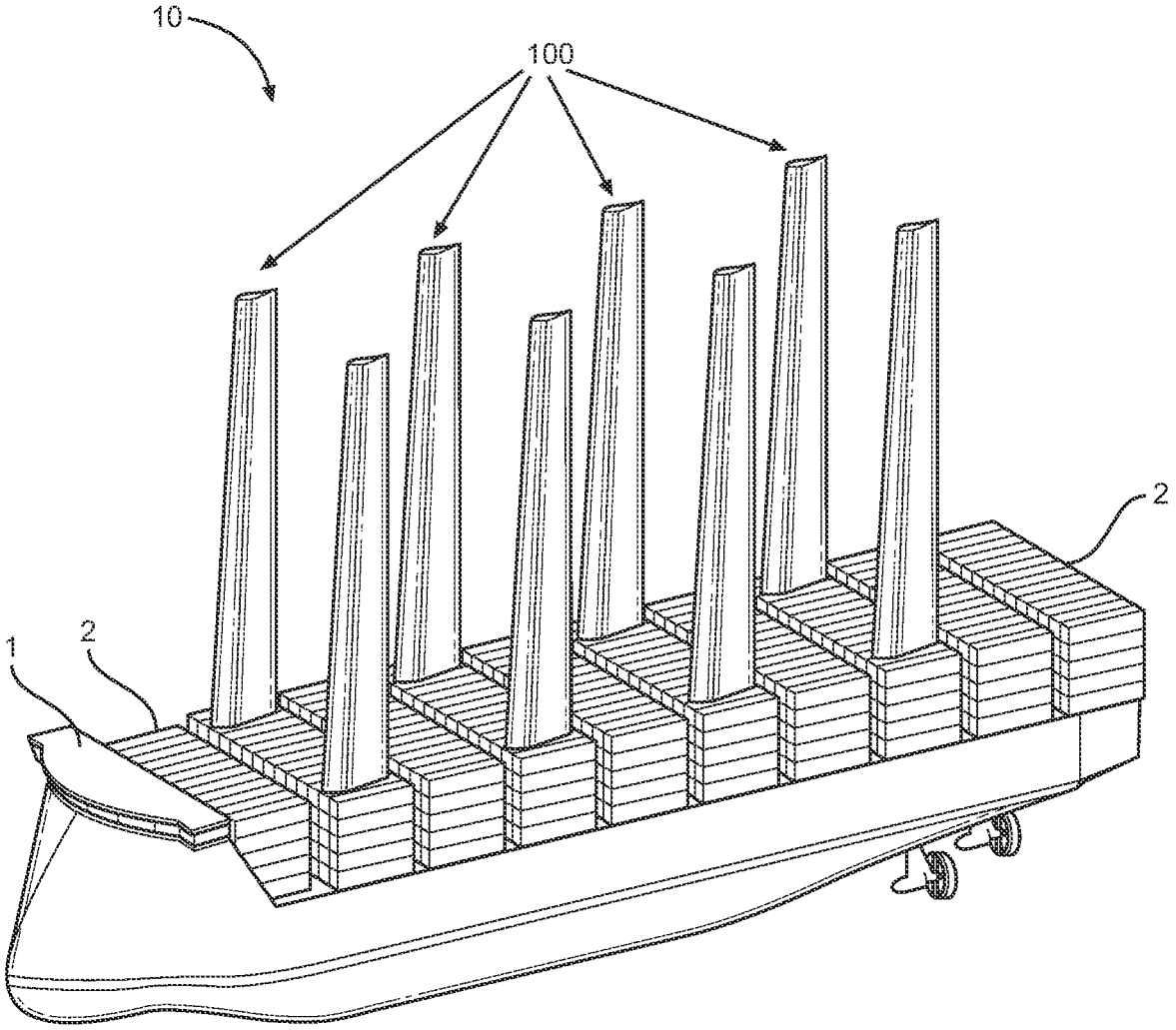
FIG. 1 illustrates in side perspective view an example system configured to facilitate propulsion of a shipping vessel according to one embodiment of the present disclosure.

Exemplary applications of apparatuses, systems, and methods according to the present disclosure are described in this section. These examples are being provided solely to add context and aid in the understanding of the disclosure. It will thus be apparent to one skilled in the art that the present disclosure may be practiced without some or all of these specific details provided herein. In some instances, well known process steps have not been described in detail in order to avoid unnecessarily obscuring the present disclosure. Other applications are possible, such that the following examples should not be taken as limiting. In the following detailed description, references are made to the accompanying drawings, which form a part of the description and in which are shown, by way of illustration, specific embodiments of the present disclosure. Although these embodiments are described in sufficient detail to enable one skilled in the art to practice the disclosure, it is understood that these examples are not limiting, such that other embodiments may be used, and changes may be made without departing from the spirit and scope of the disclosure.

The present disclosure relates in various embodiments to features, apparatuses, systems, and methods for improved aerodynamic systems for wind-aided propulsion of cargo ships and other vehicles. The disclosed embodiments involve self-deploying aerodynamic systems, and in particular systems configured to self-deploy an aerodynamic structure that can facilitate the wind-aided propulsion of a cargo ship or other shipping container bearing vehicle. This can involve an aerodynamic structure that can be automatically deployed from and stored into a container having a standardized form factor that couples to shipping containers. Use of such an automated aerodynamic structure can reduce the fuel burn of cargo ships and other water based vessels, as well as other potential shipping container carrying vehicles.

The disclosed self-deploying aerodynamic systems or individual subsystems can generally include multimodal storage containers, load transfer components, deployable and retractable aerodynamic structures, and conversion devices such as compactable spools. Other items and features can include onboard power and energy recovery functions, batteries or other energy storage items, twistlocks, tethers, support braces, and other mechanical functions and items for latching and support, rotational bearings to change angles relative to the wind, weather detectors and other sensors, and one or more processors for autonomous or semi-autonomous operations that can be located internally and/or on a vehicle bridge or other central location, among other possible items and features.

Although various embodiments disclosed herein discuss use specifically with respect to cargo ships, it will be readily appreciated that the disclosed features, apparatuses, systems, and methods can similarly be used for any other movable vessel or vehicle. While specific materials and dimensions are provided for some components and items, it will be understood that any suitable substitute or alternative materials that take advantage of the disclosed features may alternatively be used. Other applications, arrangements, and extrapolations beyond the illustrated embodiments are also contemplated.

Referring first to FIG. 1, an example system configured to facilitate propulsion of a shipping vessel is shown in side perspective view. System 10 can include multiple self-deployable aerodynamic structure subsystems 100, each of which can be removably installed onto one or more standard cargo shipping containers 2 on movable shipping vehicle 1, which can be a cargo ship or other vessel, for example. Each self-deployable aerodynamic structure subsystem 100 can be self-contained and can include its own deployable and retractable aerodynamic structure. Overall system 10 can also include at least one processor (not shown) in communication with and configured to facilitate the operational coordination of each of self-deployable aerodynamic structure subsystems 100, as set forth in greater detail below.

In various embodiments, all of self-deployable aerodynamic structure subsystems 100 can be identical or substantially similar in nature, and each subsystem 100 of overall system 10 can be its own separate system configured to self-deploy an aerodynamic structure (i.e., separate self-deploying aerodynamic system). Each self-deployable aerodynamic system 100 can include its own aerodynamic structure that is configured to be deployed to an extended configuration outside of its own outer container and to be retracted to a stored configuration within that outer container, various details of which are provided below. As shown in FIG. 1, each of the eight self-deployable aerodynamic systems 100 are depicted in a deployed or "extended" configuration where the aerodynamic structures are extended outside of the outer containers. More or fewer subsystems or systems 100 can be used for a given overall system 10, and these systems 100 can be arranged into any strategic pattern as may be desired. In addition, not all systems 100 need be deployed or extended at the same time, as some may be deployed to an extended configuration while others are retracted to a stored configuration at any given time.

Figure 2:
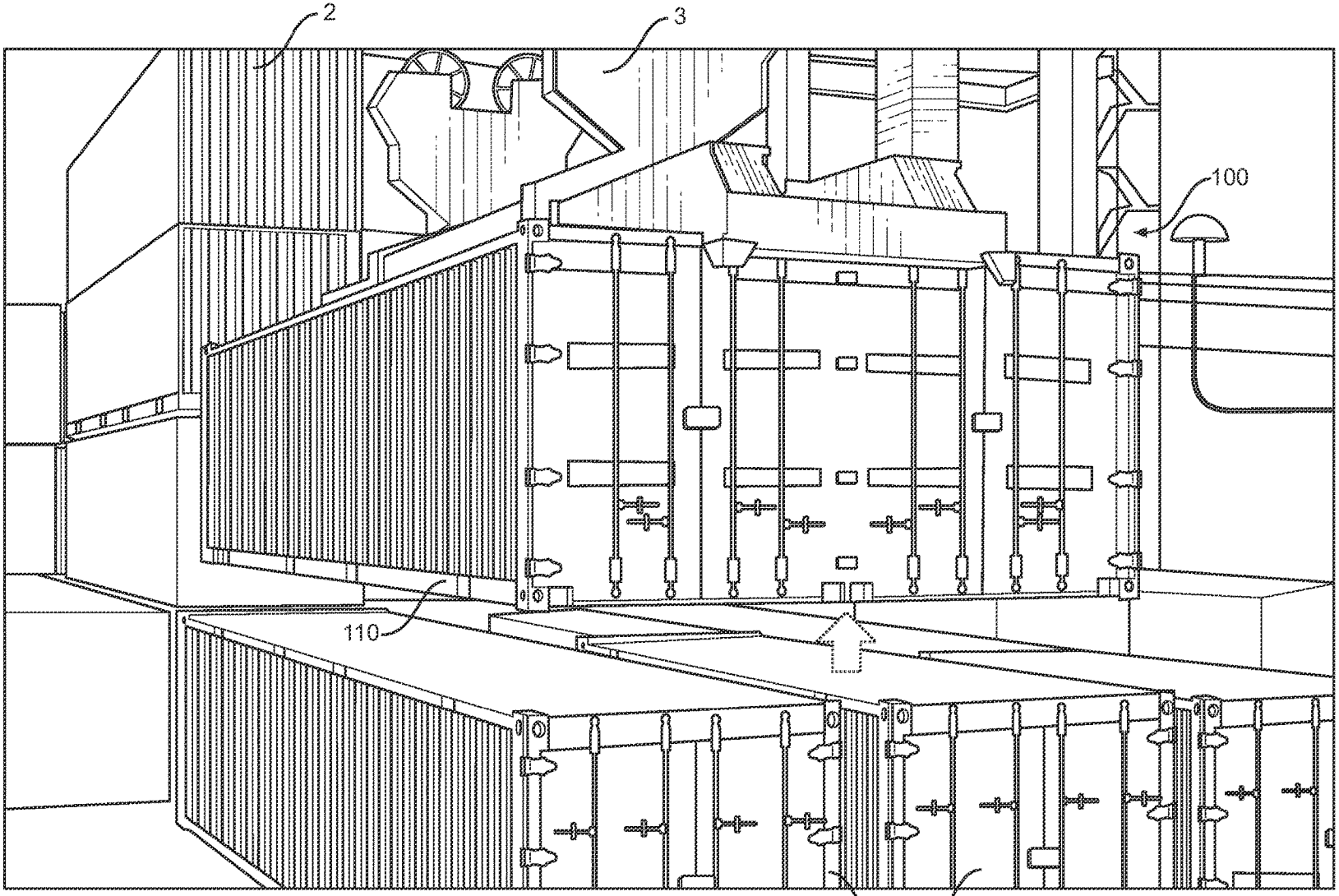
FIG. 2 illustrates in side perspective view an example self-deploying aerodynamic system being installed onto a shipping vessel carrying standard cargo shipping containers according to one embodiment of the present disclosure.

FIG. 2 illustrates in side perspective view an example self-deploying aerodynamic system being installed onto a shipping vessel carrying standard cargo shipping containers. As shown, self-deploying aerodynamic system 100 can be in a storage or "stored" configuration as it is being installed onto a shipping vessel such that only its outer container 110 is visible. In various arrangements, outer container 110 can have a standardized form factor that corresponds to the size or footprint of one or more standard cargo shipping containers. For example, outer container 110 can have the same length and width of two standard cargo shipping containers 2 arranged side-by-side, as shown in FIG. 2. This can allow the installment or placement of self-deploying aerodynamic system 100 directly atop two stacks of cargo shipping containers 2. Self-deploying aerodynamic system 100 can be removably installed to the shipping vessel by way of a crane 3 other suitable cargo shipping container moving device, as will be understood by those of skill in the art. Other sizes and arrangements are also possible, such that a given outer container 110 (and overall system 100) can be installed or placed atop fewer or more than two stacks of standard cargo shipping containers.

Figure 3A:
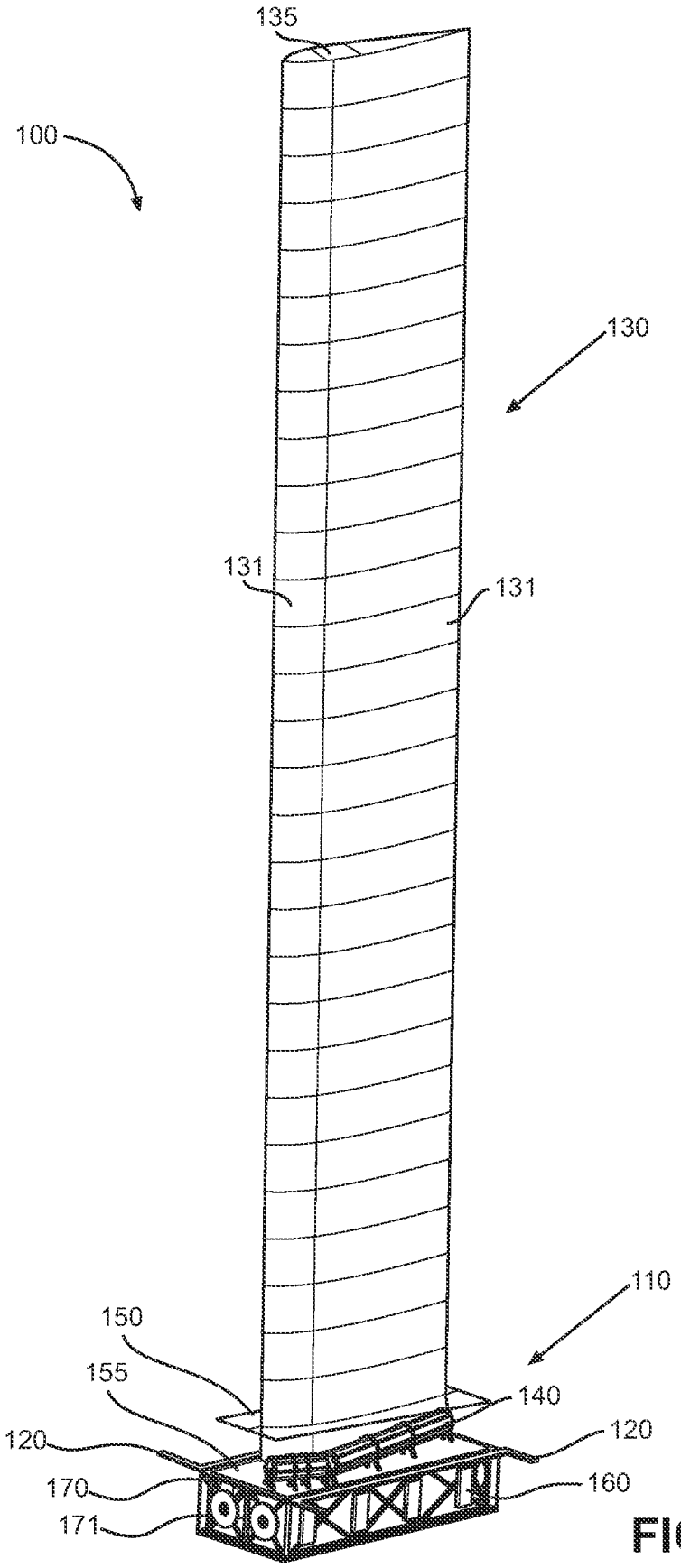
FIG. 3A illustrates in side perspective view an example self-deploying aerodynamic system in an extended configuration according to one embodiment of the present disclosure.
Figure 3B:
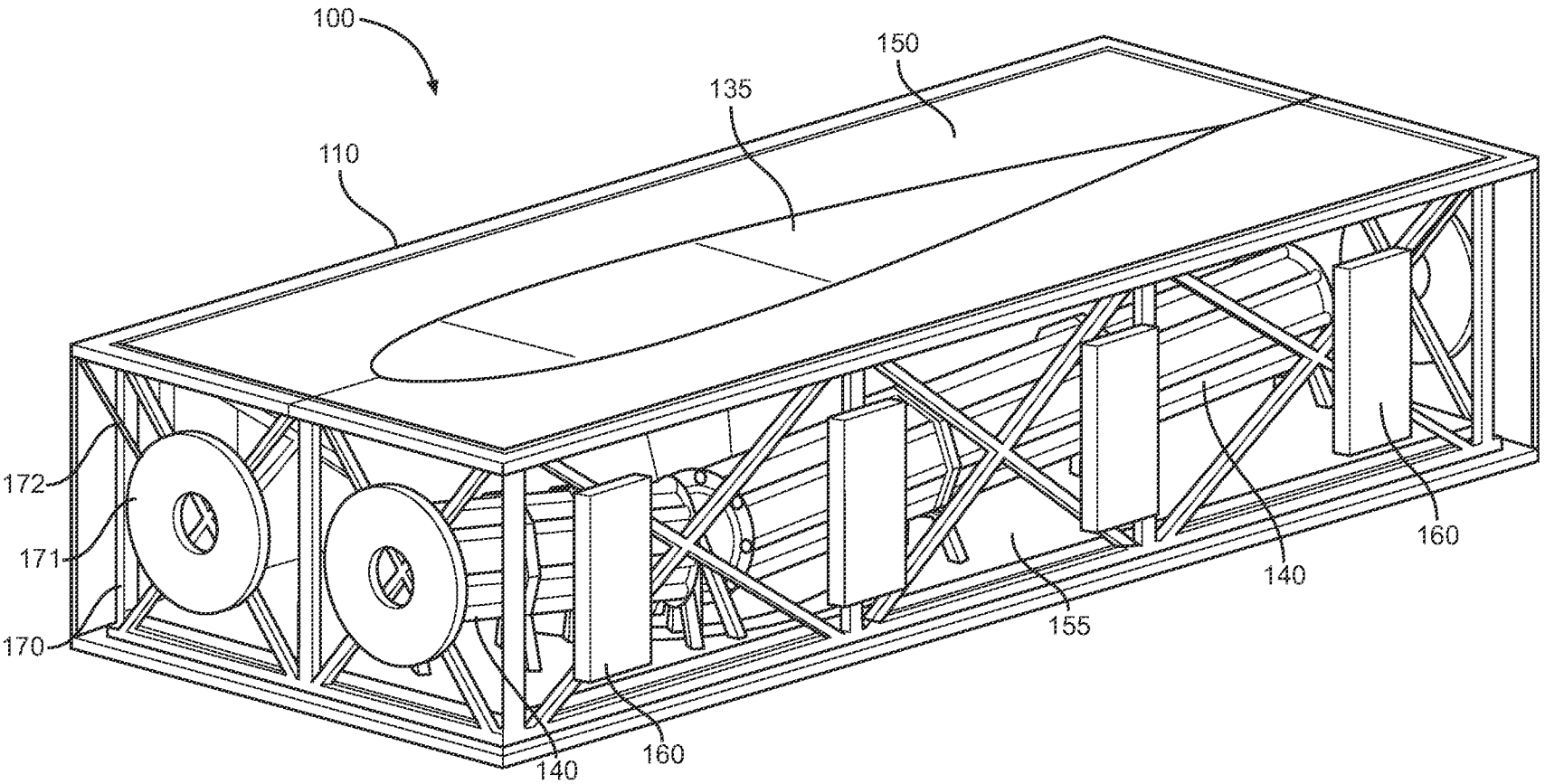
FIG. 3B illustrates in side perspective view the self-deploying aerodynamic system of FIG. 3A in a stored configuration according to one embodiment of the present disclosure.

Moving next to FIGS. 3A and 3B, an example self-deploying aerodynamic system is illustrated in side perspective views in extended and stored configurations respectively. Self-deploying aerodynamic system 100 can generally include outer container 110, one or more load transfer components 120, aerodynamic structure 130, and one or more conversion devices 140. Self-deploying aerodynamic system 100 can also include top plate 150, bottom plate 155, one or more batteries 160, one or more lift mechanisms 170, tether spools 171, and tethers 172 among other possible components and subsystems. Although the sidewalls of outer container 110 are shown as being transparent or cut-away in FIGS. 3A and 3B (and other figures herein), it will be understood that this is simply for purposes of illustration in the present disclosure, and that these sidewalls can house and block the visibility of items and components inside the outer container.

Outer container 110 can be configured to store aerodynamic structure 130 therein and deploy the aerodynamic structure therefrom. In various arrangements, most or all other parts and components of self-deploying aerodynamic system 100 can be located within or about this outer container 110 at least when the system is in a stored configuration. Outer container 110 can have a standardized form factor, such as to match one or more standard shipping containers. As noted above, outer container 110 can have a footprint that matches two standard shipping containers placed side-by-side, such that the outer container (and entire system 100) can be mounted or otherwise installed atop two standard shipping container stacks. In some arrangements, outer container 110 may have a height that is not the same as a standard shipping container, such as where the outer container is intended to be installed at the top of a shipping container stack.

One or more load transfer components 120 can be located proximate the outer container 110 and can be configured to transfer propulsion loads from self-deploying aerodynamic system 100 to a movable shipping vehicle, such as movable shipping vehicle 1 above. Load transfer components 120 can include one or more rigid mechanical braces that are configured to extend from outer container 110 when self-deploying aerodynamic system 100 is in a deployed or extended configuration. Load transfer components 120 can also be configured to retract into or fold up alongside outer container 110 when the overall self-deploying aerodynamic system 100 is in a retracted or stored configuration.

Aerodynamic structure 130 can include one or more wind capturing components configured to convert outside wind forces to propulsion loads and one or more structural components configured to stabilize and space apart the one or more wind capturing components. Aerodynamic structure 130 can be configured to be deployed to an extended configuration outside the outer container 110, as shown in FIG. 3A, and also to be retracted to a stored configuration within the outer container, as shown in FIG. 3B. Aerodynamic structure 130 can generally be referred to as a "wingsail." As such, FIG. 3A can be said to depict this wingsail in a deployed or extended state or configuration, while FIG. 3B can be said to depict this wingsail in a stored or packaged state or configuration. While the configuration in FIG. 3A can reflect a fully deployed or fully extended state or configuration of aerodynamic structure 130 and overall self-deploying aerodynamic system 100, it will also be understood that this can reflect a partially deployed or extended state or configuration, and that multiple partially extended states or configurations of intermediate heights can be achieved between the states or configurations shown in FIGS. 3A and 3B.

In some arrangements, the wind capturing components can include multiple vertically oriented tape-springs 131 arranged into the shape of a vertically oriented enclosed wingsail, while the structural components can include multiple horizontally oriented ribs 135 located within and spaced apart from the top to the bottom of the vertically oriented enclosed wingsail when aerodynamic structure 130 is in its fully deployed or extended configuration. As shown in FIG. 3A, a single rib 135 can be located across the top of the vertically oriented enclosed wingsail formed by tape-springs 131 when aerodynamic structure 130 is deployed to an extended configuration. As shown in FIG. 3B, this same single rib 135 can remain atop the aerodynamic structure and can lay flush within top plate 150 when the aerodynamic structure is retracted to its stored configuration within outer container 110. As shown in FIG. 3A, two tape-springs 131 can be temporarily coupled to each other at a vertical line along one side of the vertically oriented enclosed wingsail or aerodynamic structure 130, while horizontal lines along the height of the wingsail or aerodynamic structure can reflect the internal locations of ribs within the structure.

One or more conversion devices 140 can be configured both to deploy automatically aerodynamic structure 130 from the stored configuration to the extended configuration and to retract automatically the aerodynamic structure from the extended configuration to the stored configuration while self-deploying aerodynamic system 100 is removably installed on a movable shipping vehicle. Conversion device(s) 140 can be positioned beneath top plate 150 and atop bottom plate 155 such that these conversion devices elevate and descend with the top and bottom plates. In some arrangements, each conversion device 140 can include a spooling arrangement for each wind capturing component, such as each tape-spring 131. Each spooling arrangement can have a rotating drum configured to wrap a tape-spring 131 or other wind capturing component thereabout when aerodynamic structure 130 is in its stored configuration.

Top plate 150 can be located across and cover a top opening of outer container 110 at a top plate storage position when aerodynamic structure 130 is in its stored configuration inside the outer container, as shown in FIG. 3B. Top plate 150 can be configured to elevate from this top plate storage position to a top plate extended position when aerodynamic structure 130 is in its extended configuration, as shown in FIG. 3A, and can also be configured to descend back to its top plate storage position. Top plate 150 can have various features, such as a central opening sized and shaped to pass horizontally oriented ribs therethrough during deployment and retraction, as well as to hold a top rib 135 therein when the top plate is in the top plate storage position and aerodynamic structure 130 is in its stored configuration. Top plate 150 can also include one or more features configured to guide the extension and the retraction of tape-springs 131 or other wind capturing components, as noted below.

Bottom plate 155 can be located within and proximate the bottom of outer container 110 at a bottom plate storage position when aerodynamic structure 130 is in its stored configuration inside the outer container. Bottom plate 155 can be configured to elevate from its bottom plate storage position to a bottom plate extended position proximate the top opening of outer container 110 when aerodynamic structure 130 is in its extended configuration, as shown in FIG. 3A, and can also be configured to descend back to its bottom plate storage position. Top plate 150 and bottom plate 155 can be configured to elevate and descend together, such that conversion devices 140 and other components and items located therebetween also elevate and descend together with the top and bottom plates. In some arrangements, the bottom plate extended position can elevate to be higher than the sidewalls of outer container 110, such as where the entire aerodynamic structure 130, top plate 150, bottom plate 155, conversion devices 140, and other components and items located between the top and bottom plates can all be rotated together as a combined unit when self-deploying aerodynamic system 100 is in a deployed or extended configuration, as set forth in greater below.

Figure 4:
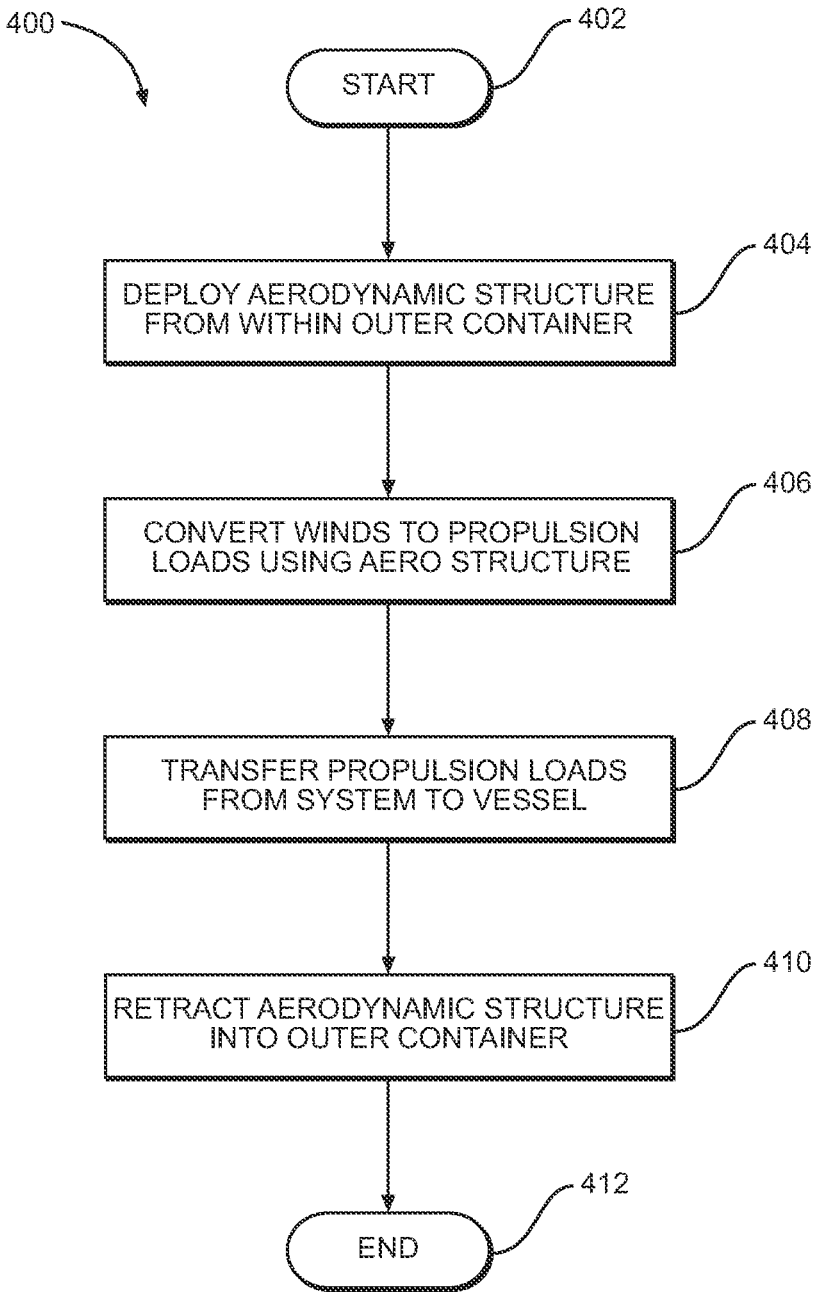
FIG. 4 illustrates a flowchart of an example summary method of using an aerodynamic structure on a movable shipping vehicle according to one embodiment of the present disclosure.

Continuing with FIG. 4, a flowchart of an example summary method 400 of using an aerodynamic structure on a movable shipping vehicle is provided. Summary method 400 can represent one broad aspect of overall methods of use for an aerodynamic structure, and it will be understood that various other steps, features, and details of such a broad aspect and overall methods of use are not provided here for purposes of simplicity.

After a start step 402, a first process step 404 can involve deploying a stored aerodynamic structure from within an outer container. The outer container can be part of a self-deploying aerodynamic system that includes the aerodynamic structure. The deploying can form an extended aerodynamic structure, and can take place while the self-deploying aerodynamic system is installed onto a movable shipping vehicle. Step 404 can be manually or automatically performed, such as where a separate robotic system can be configured to deploy the stored aerodynamic structure based on a sensed condition or user input.

At a following process step 406, outside wind forces can be converted to propulsion loads using the extended aerodynamic structure. Step 406 can be manually or automatically performed, such as where the extended aerodynamic structure is arranged to capture wind and convert the wind forces to propulsion loads due to its wing shape and orientation to the wind.

At the next process step 408, the propulsion loads can be transferred from the self-deploying aerodynamic system to the movable shipping vehicle. This can result in the propulsion loads being used to at least partially propel the movable shipping vehicle. Step 408 can be manually or automatically performed, such as where the extended aerodynamic structure is arranged to transfer the propulsion loads through the system to one or more load transfer components in the system which in turn transfer the propulsion loads from the system to one or more load accepting components of the movable shipping vehicle.

At subsequent process step 410, the extended aerodynamic structure can be retracted into the outer container of the self-deploying aerodynamic system. This can then reform the stored aerodynamic structure. Step 410 can be manually or automatically performed, such as where a separate robotic system can be configured to retract the extended aerodynamic structure based on a sensed condition or user input. The method can then end at end step 412.

Transitioning now to FIGS. 5A-5F, an example self-deploying aerodynamic system is depicted in various transitional phases from stored to extended configurations. Starting with FIG. 5A, self-deploying aerodynamic system 100 is shown in a first transitional phase from stored to extended configurations. This first transitional phase can simply reflect the deployment of side braces or other load transfer components 120 from a retracted or folded up position within or against outer container 110. These side braces can be configured to brace against other cargo shipping containers or other items on a movable shipping vehicle, which can stabilize self-deploying aerodynamic system 100 in place and can also serve to transfer at least some of the propulsion loads from the system to the vehicle. All other items can remain in the same position in this first transitional phase from the stored configuration for self-deploying aerodynamic system 100, such as that which is shown in FIG. 3B. For example, top plate 150 and top rib 135 can remain atop an upper opening of outer container 110, while bottom plate 155 and conversion devices 140 can remain inside the outer container.

Figure 5A:
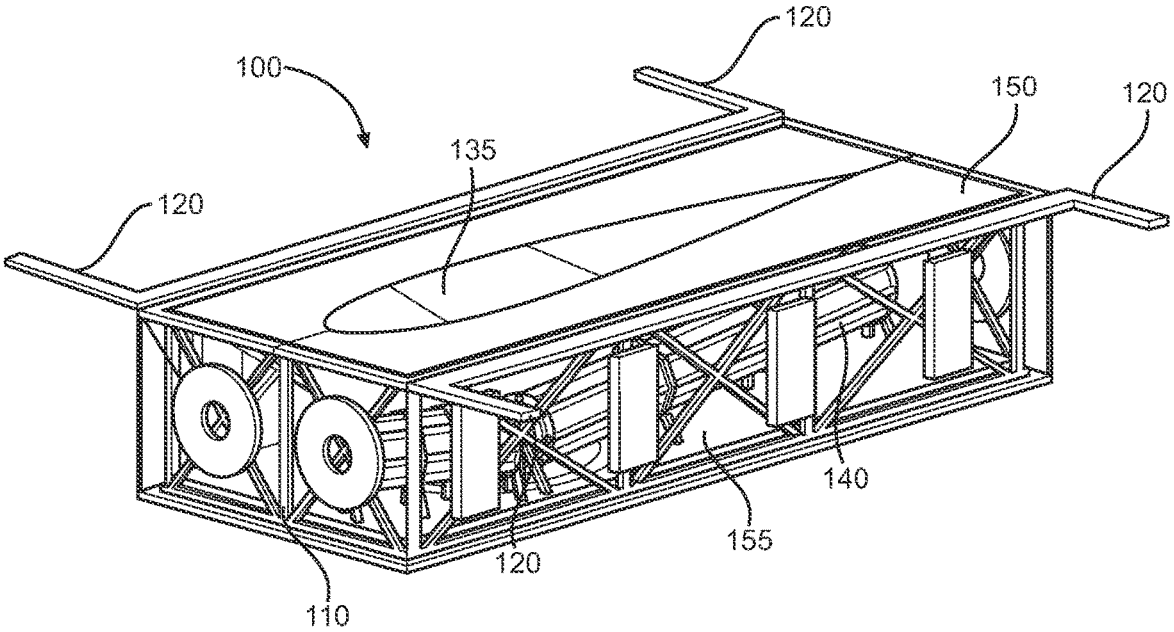
FIG. 5A illustrates in side perspective view an example self-deploying aerodynamic system in a first transitional phase from stored to extended configurations according to one embodiment of the present disclosure.
Figure 5B:
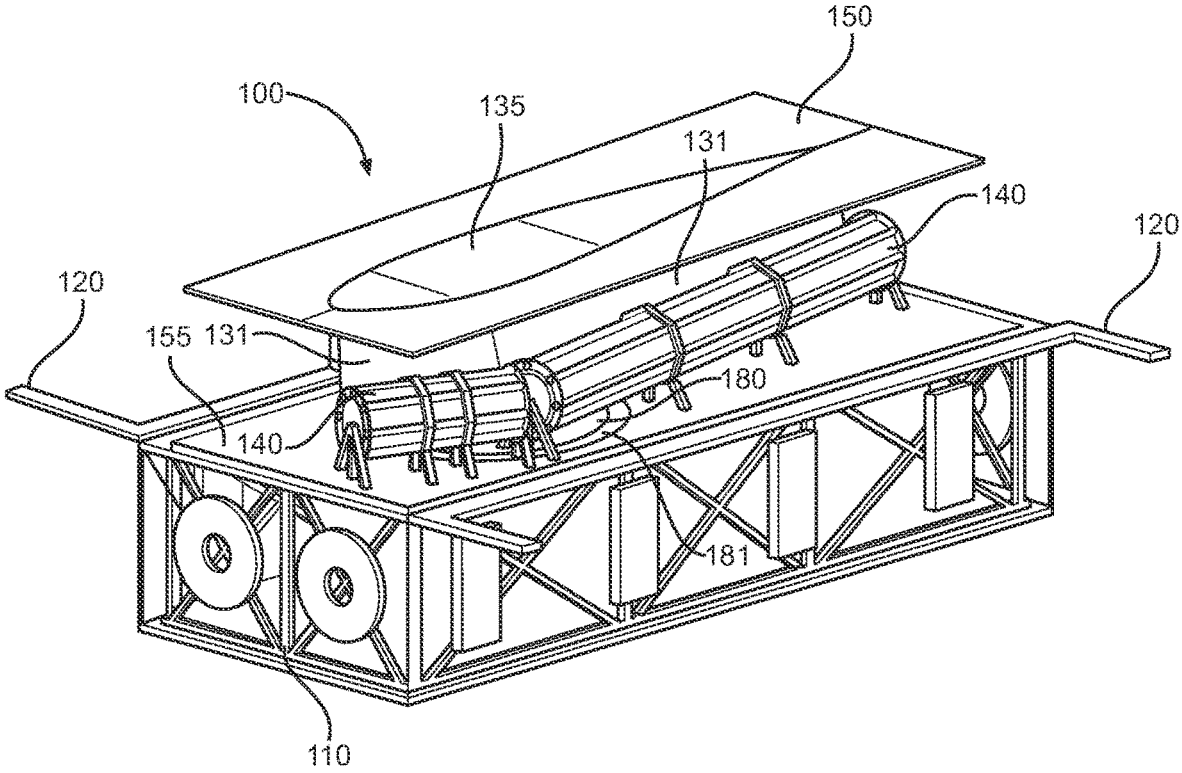
FIG. 5B illustrates in side perspective view the self-deploying aerodynamic system of FIG. 5A in a second transitional phase from stored to extended configurations according to one embodiment of the present disclosure.

FIG. 5B illustrates in side perspective view the self-deploying aerodynamic system of FIG. 5A in a second transitional phase from stored to extended configurations. In this second transitional phase, top plate 150, bottom plate 155, and all components therebetween can be elevated together from storage positions within outer container 110 to elevated positions outside and above the outer container. This can include all tape-springs 131, all ribs 135, all spooling arrangements or other conversion devices 140, and other items located between top plate 150 and bottom plate 155. As shown in FIG. 5B, this second transitional phase has not yet involved unspooling rolled up tape-springs 131 from conversion devices 140 and extending these tape-springs vertically, and similarly has not yet involved elevating and separating ribs 135 from each other. Elevating bottom plate 155 can also expose a turntable arrangement 180 located toward the middle of the bottom plate, which arrangement can include a rotational bearing 181 coupling the aerodynamic structure to outer container 110. This rotational bearing 181 and overall turntable arrangement 180 can be configured to facilitate rotation of the aerodynamic structure about a vertical axis relative to outer container 110 when the aerodynamic structure is in its extended configuration, as set forth in greater detail below.

Figure 5C:
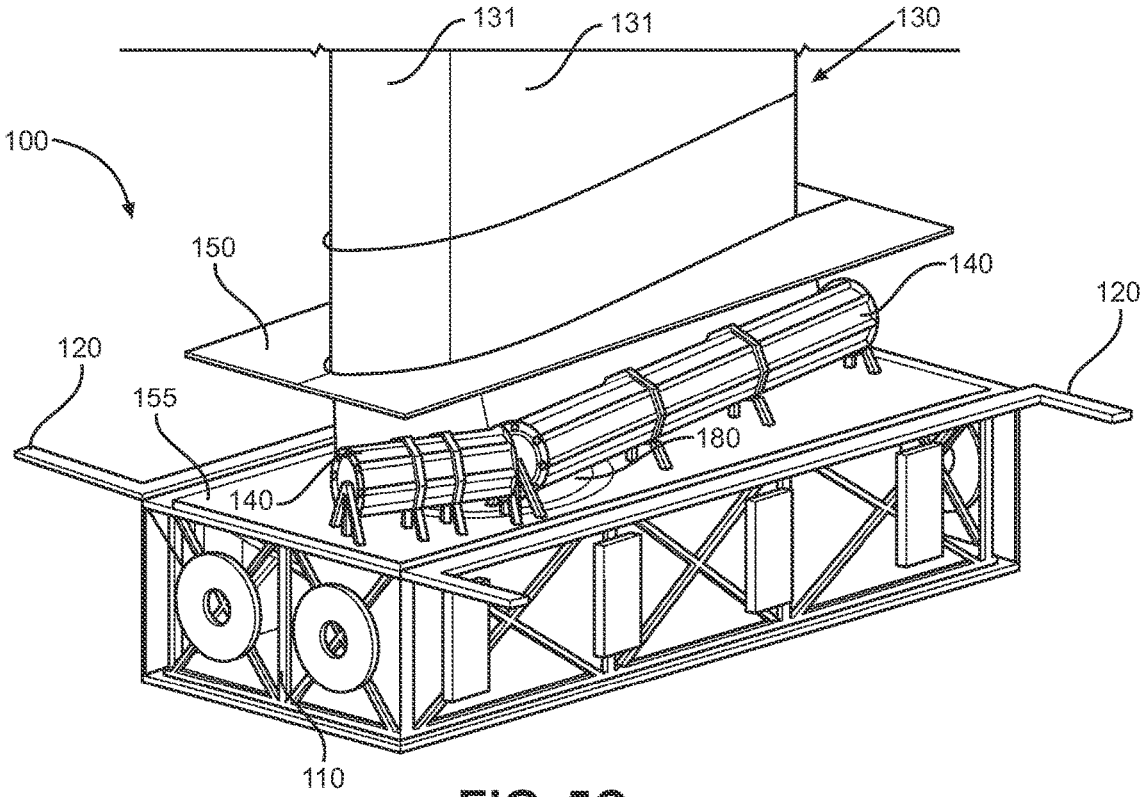
FIG. 5C illustrates in side perspective view the self-deploying aerodynamic system of FIG. 5B in a third transitional phase from stored to extended configurations according to one embodiment of the present disclosure.
Figure 5D:
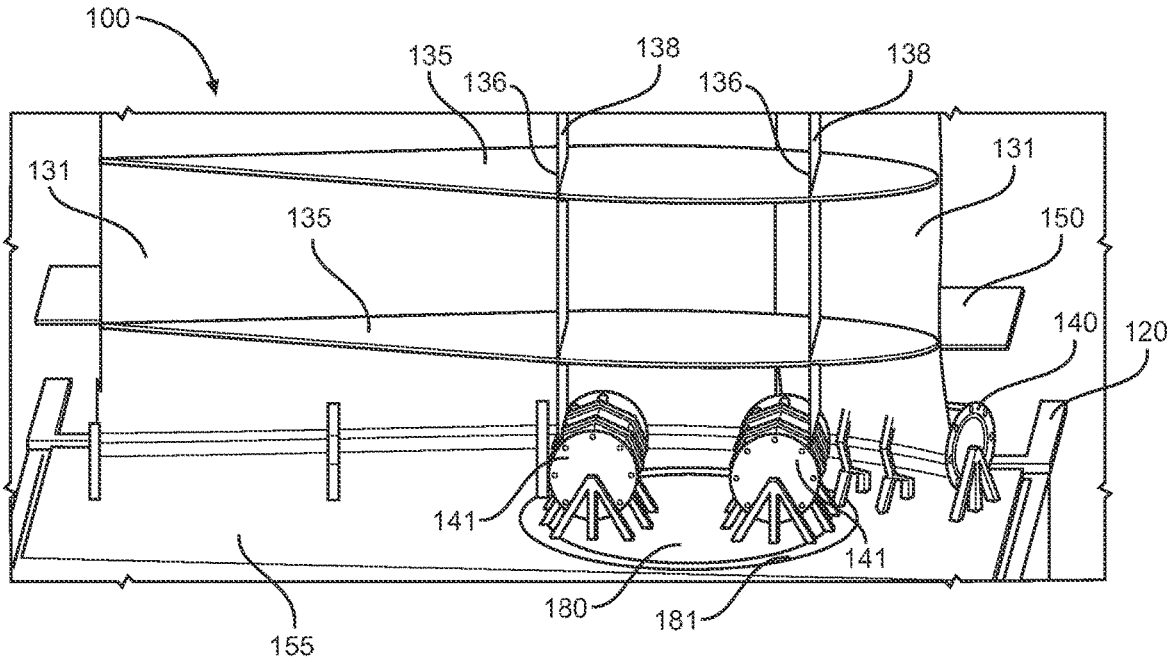
FIG. 5D illustrates in obverse side perspective partial cut-away view the self-deploying aerodynamic system of FIG. 5C in the third transitional phase from stored to extended configurations according to one embodiment of the present disclosure.

FIG. 5C illustrates in side perspective view and FIG. 5D illustrates in obverse side perspective partial cut-away view the self-deploying aerodynamic system of FIG. 5B in a third transitional phase from stored to extended configurations. In this third transitional phase, tape-springs 131 have been unrolled fully or at least partially from their respective conversion devices 140 and raised vertically to form or start forming the shape of a vertically oriented enclosed wingsail. Horizontally oriented ribs 135 have also been raised and spaced vertically as tape-springs 131 have been unrolled and raised vertically. It will be understood that the partial views shown in FIGS. 5C and 5D can represent what a lower region of aerodynamic structure 130 looks like both when the entire aerodynamic structure is fully deployed and extended, as well as what this lower region of the aerodynamic structure can look like as the upper region of the structure continues to deploy and extend to its full vertical height. Of course, during partial deployment and partial retraction, more tape-spring material may still be rolled onto conversion devices 140 and some of ribs 135 may be stacked onto each other rather than spaced apart.

In various embodiments as shown herein for non-limiting purposes of illustration, self-deploying aerodynamic system 100 can have four separate tape-springs 131, each extending vertically upward from four separate conversion devices 140. These four tape-springs 131 can be arranged to have one short tape-spring and one long tape-spring on mirror image sides of vertically oriented aerodynamic structure 130 such that these four tape-springs combine during deployment to form a single vertically oriented wingsail that takes the cross-sectional shape of horizontally oriented ribs 135. It is specifically contemplated that more or fewer tape-springs can be used for this purpose and that alternative wingsail shapes may also be formed in other alternatively designed arrangements. Furthermore, partial deployment or extension of a given aerodynamic structure 130 of overall self-deploying aerodynamic system 100 can be achieved in some arrangements by extending tape-springs 131 to less than their fully extendable vertical height, as well as by fully spacing apart only some of all ribs 135 or by spacing apart all of the ribs by amounts that are less than the maximum possible spacing between ribs.

FIG. 5D shows how horizontally oriented ribs 135 can be vertically spaced within tape-springs 131, with this rib spacing pattern extending upward vertically for all ribs up to the top rib across the tops of the four vertically oriented tape-springs arranged into the shape of a vertically oriented enclosed wingsail when aerodynamic structure 130 is fully extended, as is reflected in FIG. 3A. One or more vertically arranged spars 138 located in an inner region between tape-springs 131 can form further structural components of aerodynamic structure 130. Spars 138 can be located between, extending through, and configured to facilitate the spacing of multiple horizontally oriented ribs 135 when aerodynamic structure 130 is in its fully extended configuration or even when partially extended. Each horizontally oriented rib 135 can have transverse slots 136 located therein to facilitate spars 138 passing therethrough. One or more locking features (not shown) can facilitate temporarily locking a rib in place to spars 138 when spacing between ribs is appropriate during the deployment or retraction of aerodynamic structure 130. Similar or alternative locking features around the outer circumferences of ribs 135 can similarly facilitate temporarily locking a rib in place to tape-springs 131 when spacing between ribs is appropriate during the deployment or retraction of aerodynamic structure 130.

Spars 138 can be similar to tape-springs 131 in that they can be formed from the same or similar materials and can be extended vertically from internal conversion devices 141, which can be located within the inner region between tape-springs 131. While not shown in FIG. 5C, two tape-springs 135 and corresponding externally located conversion devices 140 have been cut away in FIG. 5D to show the internal locations of internal conversion devices 141, spars 138, ribs 135, and rib slots 136. Internal conversion devices 141 can be atop bottom plate 155 or atop turntable arrangement 180 within the bottom plate. Each internal conversion device 141 can include a spooling arrangement for each spar 138 or other vertically extendable structural component located within an inner region of the wingsail structure. Similar to externally located conversion devices 140 above, each internal conversion device 141 can have a spooling arrangement that includes a rotating drum configured to wrap the material of spar 138 or other vertically extendable structural component thereabout when aerodynamic structure 130 is in or being retracted to its stored configuration.

Figure 5E:
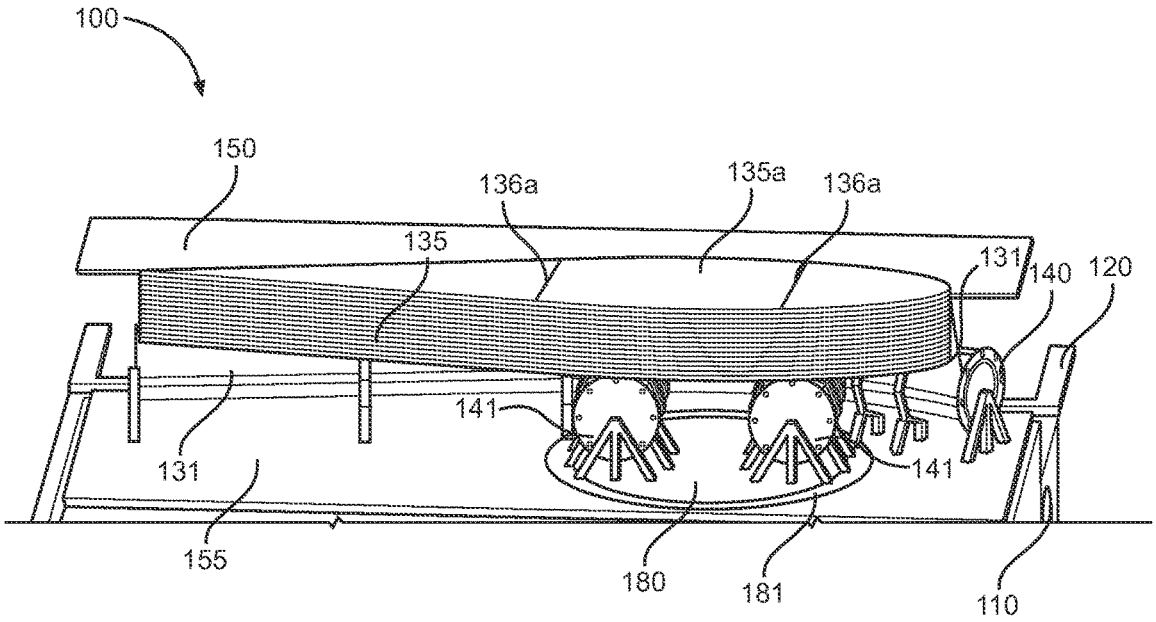
FIG. 5E illustrates in obverse side perspective partial cut-away view the self-deploying aerodynamic system of FIG. 5B in the second transitional phase from stored to extended configurations according to one embodiment of the present disclosure.

FIG. 5E illustrates in obverse side perspective partial cut-away view the self-deploying aerodynamic system of FIG. 5B in the second transitional phase from stored to extended configurations. FIG. 5E provides an alternate view of the second transitional phase shown in FIG. 5B similar to how FIG. 5D provides an alternate view of the third transitional phase shown in FIG. 5C. Again, second transitional phase shown in FIGS. 5B and 5E can involve top plate 150, bottom plate 155, and all components therebetween being elevated together from storage positions within outer container 110 to elevated positions outside and above the outer container. This can include all tape-springs 131, ribs 135, spars 138, conversion devices 140, 141, turntable arrangement 180, rotational bearings 181, and other items and features located between top and bottom plates 150, 155. Again, second transitional phase has not yet involved unspooling rolled up tape-springs 131 and spars 138 from conversion devices 140, 141 and extending these tape-springs and spars vertically, and similarly has not yet involved elevating and separating ribs 135 from each other, such that ribs 135 are all stacked together beneath a top rib 135*a* that can lay flush with top plate 150 inside a rib-shaped central opening within the top plate. All of these items can remain in the same positions relative to each other from overall stored positions within outer container 110 to the elevated positions shown.

In some arrangements, top rib 135*a* can differ somewhat from remaining ribs 135. For example, the tops of each of tape-springs 131 and the tops of each of spars 138 can be more permanently coupled or attached to top rib 135*a*. Each of the four tape-springs 131 (two shown along one side and two cut away and not shown) can be coupled or directly attached around the circumference of top rib 135*a*, while each of spars 138 can be coupled or directly attached to modified rib slots 136*a* along the top rib. Such couplings can be arranged such that when some or all of external and internal conversion devices 140, 141 begin unspooling otherwise extending tape-springs 131 and spars 138 rolled up thereupon, the extending tape-springs and spars can collectively push top rib 135*a* upward. These unspooling arrangements or other external and internal conversion devices 140, 141 can be operated in coordinated fashion and can also be automatically controlled both in unspooling and spooling their tape-springs 131 and spars 138 between extended, stored, and intermediate (i.e., partially extended) configurations. In some arrangements, a bottom rib of the entire stack of ribs 135 can be permanently coupled or attached to one or more other components or items, such as to prevent overextension of the tape-springs or spars. Alternatively, or in addition, conversion devices 140, 141 can have safety stop features.

As tape-springs 131, spars 138, and top rib 135*a* coupled thereto begin to be extended vertically upward in coordinated fashion forming the top of a combined wingsail structure during deployment, inner surfaces of the tape-springs can glide alongside the outer circumferences of all ribs 135 still stacked together while the spars can pass through the rib slots within all ribs still stacked together. During upward extension of tape-springs 131, spars 138, and top rib 135*a*, one or more sensors (not shown) can detect when top rib 135*a* is sufficiently spaced apart from the next rib 135 in the stack located directly below the top rib. At this point during deployment, various locking features (not shown) can facilitate temporarily locking that next rib 135 in place to the upward extending spars 138 at rib slots 136 in the next rib and/or to one, some, or all of the upward extending tape-springs 131 along the outer circumference of the next rib. This process can then be repeated for each rib 135 in the stack of ribs when the spacing between ribs is detected to be sufficient by the sensor(s). Such a rib to rib spacing can be about two meters, for example, although other spacing amounts between ribs can be used.

A similar process can be used during retraction of tape-springs 131 and spars 138 as these components are rolled onto their respective conversion devices 140, 141. For example, the couplings of the lowest rib to be temporarily coupled to tape-springs 131 and spars 138 can be released when that rib is lowered and stacked atop the rib beneath it, such that all tape-springs and spars can then pass alongside or through that rib during further retraction. This rib by rib release of temporary couplings can then be repeated for each rib until a full retraction to the stored configuration is reached or alternatively until a partially deployed height of the overall wingsail or other aerodynamic structure is achieved, as may be desired.

Figure 5F:
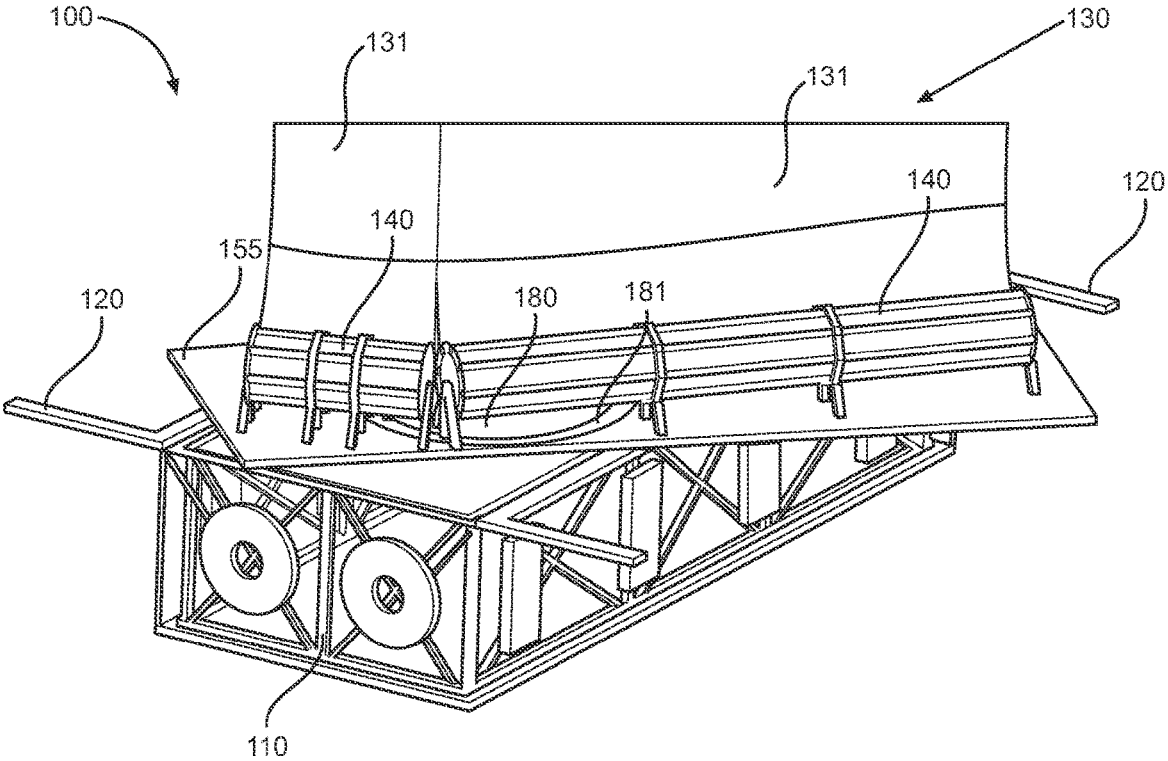
FIG. 5F illustrates in side perspective view an example self-deploying aerodynamic system in an extended and rotated configuration according to one embodiment of the present disclosure.

FIG. 5F illustrates in side perspective view an example self-deploying aerodynamic system in an extended and rotated configuration. As noted above, the entire wingsail or other aerodynamic structure 130 and other associated components and items can be configured to rotate together with respect to outer container 110 when the aerodynamic structure is deployed. This can allow self-deploying aerodynamic system 100 to be better at capturing outside wind forces and converting those forces to propulsion loads regardless of the direction of the wind, changing wind directions, and the orientation of outer container 110. In various embodiments, the rotational orientation of aerodynamic structure 130 can be rotated when the structure and overall system 100 is deployed to a fully extended configuration or to some or all intermediate or partially extended configurations between fully extended and stored configurations.

As noted above, top plate 150, bottom plate 155, and some or all components and items located above the bottom plate can be elevated to a position that is above an upper opening of outer container 110. At this elevated position, turntable arrangement 180 can be used to rotate bottom plate 155 about a vertical axis relative to outer container 110. Such a vertical axis can extend through the center of turntable arrangement 180, for example. Such rotation can also rotate everything above bottom plate 155 together, including all of aerodynamic structure 130. In some arrangements, turntable arrangement 180 can include a central portion or region that can remain rotationally stationary with respect to outer container 110, while one or more rotational bearings 181 can facilitate rotation of bottom plate 155 around this central portion or region. The range of rotation can be at least 90 degrees or up to 180 degrees in both clockwise and counterclockwise directions, although other ranges of rotation are also possible. One or more suitable motors and other drive components (not shown) can be used to facilitate rotation of bottom plate 155 about turntable arrangement 180, as will be readily appreciated.

Figure 6A:
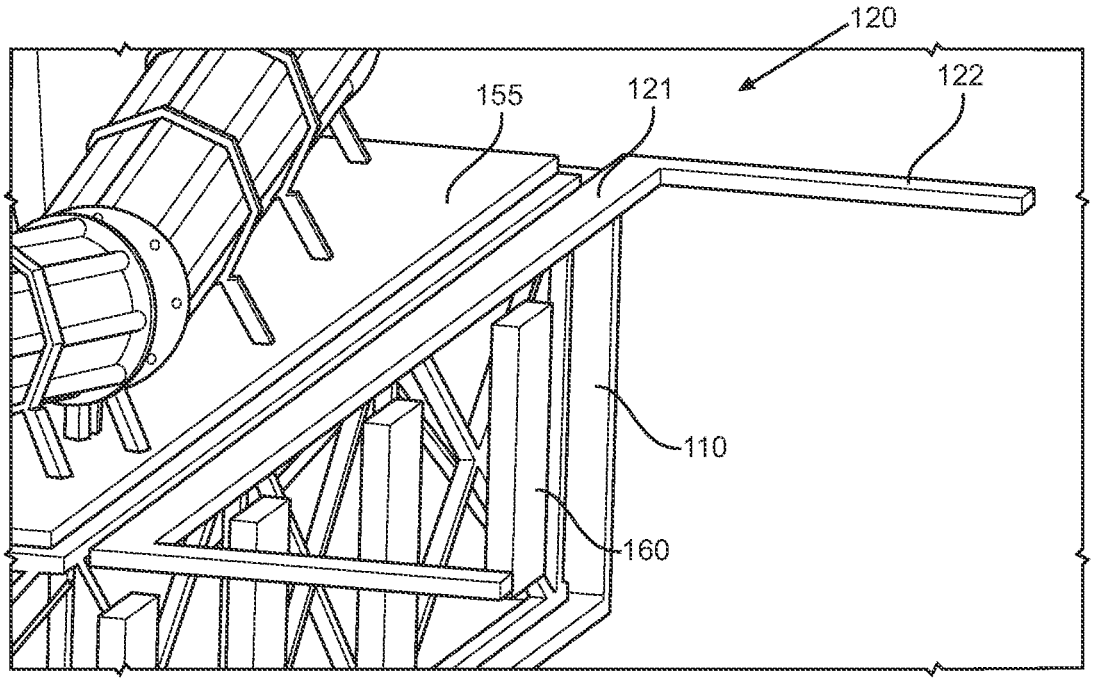
FIG. 6A illustrates in front perspective view an example side brace for a self-deploying aerodynamic system according to one embodiment of the present disclosure.

Moving next to FIG. 6A through FIG. 10, further details for various components of a self-deploying aerodynamic system will now be provided. FIG. 6A illustrates in front perspective view an example side brace for a self-deploying aerodynamic system. One or more side braces 121 can include or can be one form of load transfer component 120 configured to transfer propulsion loads from a self-deploying aerodynamic system 100 to a movable shipping vehicle. Each side brace 121 can be coupled to outer container 110 along an upper side edge thereof and can include one or more arms 122 extending therefrom to brace against adjacent shipping containers and/or other stable items or features of the movable shipping vehicle. This can facilitate holding outer container 110 in place and can also facilitate transferring propulsion loads. As noted above, each side brace 121 can be a mechanical brace configured to extend from outer container 110 when the overall self-deploying aerodynamic system is in a deployed or extended configuration, and to retract into or fold up alongside the outer container when the overall self-deploying aerodynamic system is in a retracted or stored configuration. Optional similarly shaped and operable end braces (not shown) can be coupled along the upper end edges of outer container 110 to provide additional forms of load transfer components.

In some arrangements, each side brace 121 can retract to form a portion of a lid or upper covering for outer container 110 when the overall self-deploying aerodynamic system is in a retracted or stored configuration. In some arrangements, extension and retraction of side braces 121 or other load transfer components can involve electrical or hydraulic actuation, which can be automatically performed by a control system. Twist-lock mechanisms or other locking or stabilizing items (not shown) can be used to mechanically latch arms 122 or other load transfer components onto adjacent shipping containers or other stable items. In addition, each side brace 121 or other load transfer component can be configured to rotate upward or downward so as to move its arms 122 through up to or more than 180 degrees of total motion, which can facilitate bracing against adjacent containers or other stable items that might be lower or higher than the level of the side braces and outer container 110.

Figure 6B:
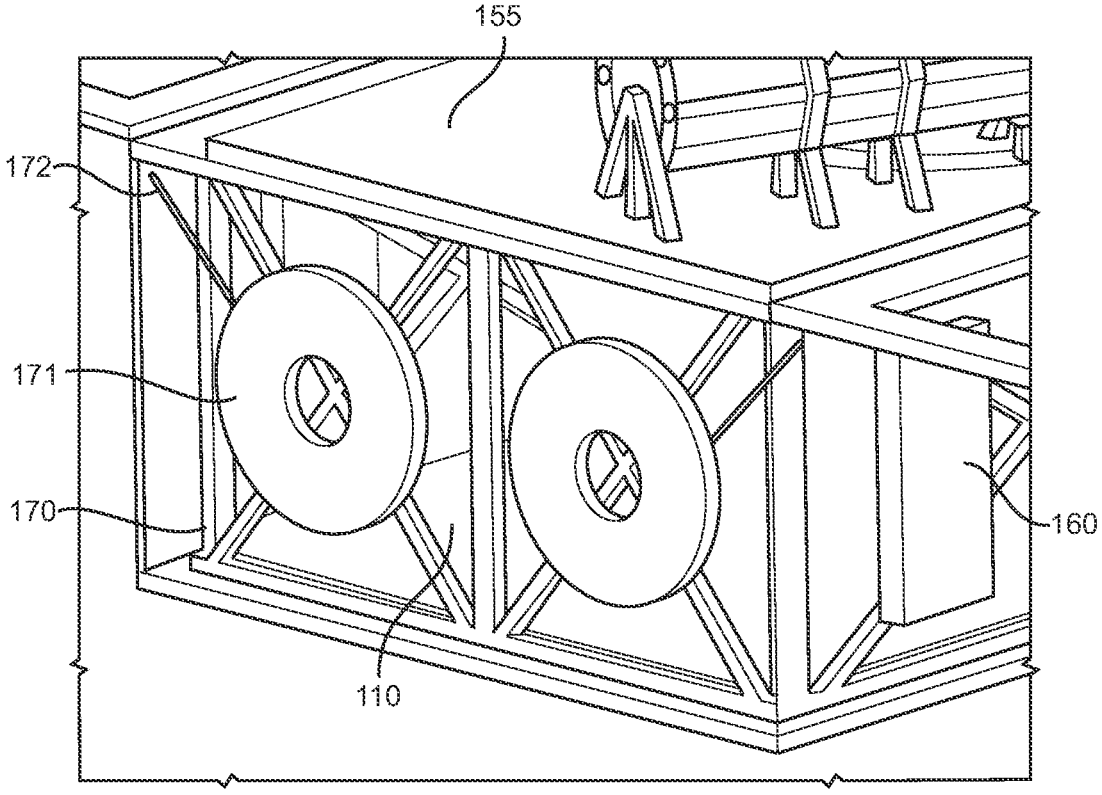
FIG. 6B illustrates in front perspective view an example tether and spool arrangement for a self-deploying aerodynamic system according to one embodiment of the present disclosure.

Continuing with FIG. 6B, an example lift mechanism and tether and tether spool arrangement for a self-deploying aerodynamic system is shown in front perspective view. Outer container 110 can include one or more lift mechanisms 170 that can collectively function to elevate bottom plate 155 from its bottom plate storage position to its bottom plate extended position above upper opening at the top of outer container 110 as shown. Lift mechanisms 170 can be automatically operated and controlled by one or more motors (not shown) and can also lower bottom plate 155 back to its bottom plate storage position inside and proximate the bottom of outer container 110. One or more tethers 172 can be stored onto tether spools 171 located along inner walls of the outer container. One or more of such tethers 172 can extend from tether spools 171 out of top corners and/or along upper edges of outer container 110 and can be deployed to a deck level or other suitable location on a movable vehicle to tie or otherwise attach to stable items to facilitate stabilizing or supporting the outer container and overall system. Tether material can be steel cables, for example, among other possible materials. Tether spools 171 can include auto-tension features and can be operated by way of electric motors, for example, which can be automatically controlled.

In various arrangements, one or more batteries 160 can be located along the container sidewalls and/or at other suitable locations inside outer container 110. Batteries 160, which can be rechargeable, can provide energy storage that can be used to power some or all of the powered devices and components of overall self-deploying aerodynamic system 100, such that the system does not need to draw power from the vessel or other movable vehicle. System devices and components that can be powered by batteries 160 can include various motors used to operate load transfer components 120, top and bottom plate elevation and lowering arrangements, spooling arrangements for conversion devices 140, 141, and rotatable features of turntable arrangement 180, as well as various clamping and unclamping components, sensors, system processors, and/or other electrically operable components and systems. An overall energy system can include multiple rechargeable batteries 160 arranged into multiple redundant packs as well as one or more energy recovery devices (not shown). Energy recovery devices can include, for example, one or more solar panels and/or wind turbines located on suitable regions of the wingsail, top rib, top plate, bottom plate, and/or outer container. Batteries 160 can also be configured to be recharged when the overall system 100 is removed from the movable shipping vehicle and electrically coupled to an outlet or recharging station, such as when a shipping container vessel is in port, for example.

Figure 7A:
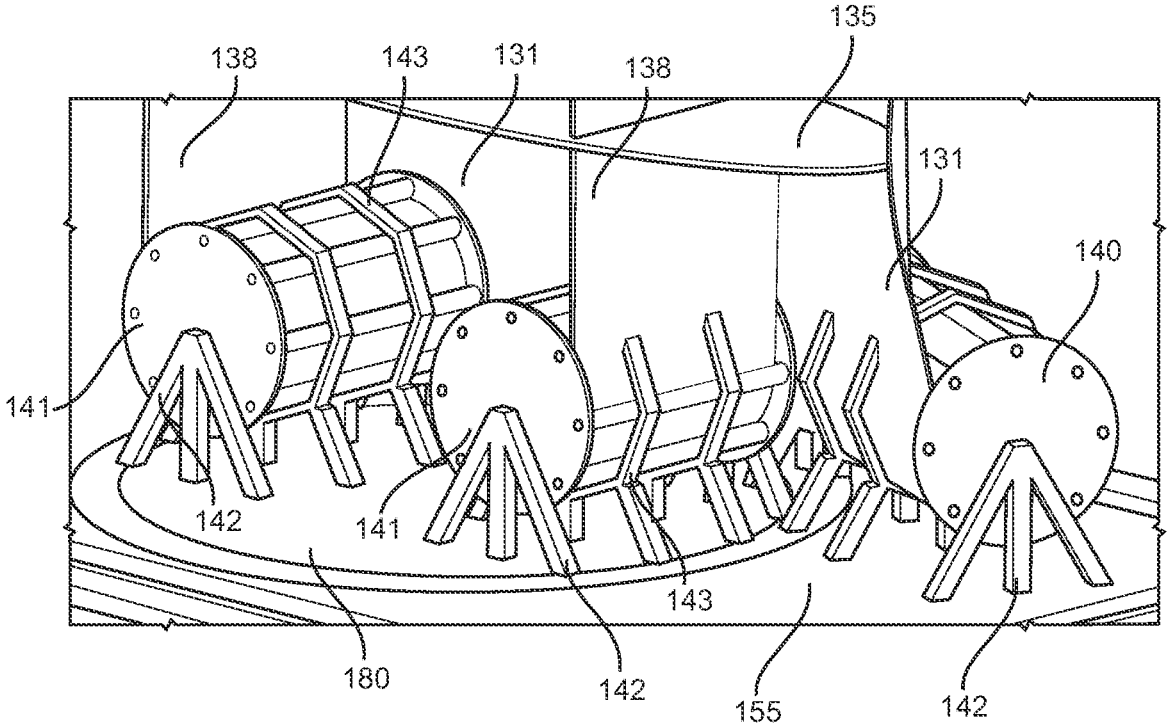
FIG. 7A illustrates in front perspective view an example partial spar, tape-spring, and internal and external spooling arrangements for a self-deploying aerodynamic system according to one embodiment of the present disclosure.
Figure 7B:
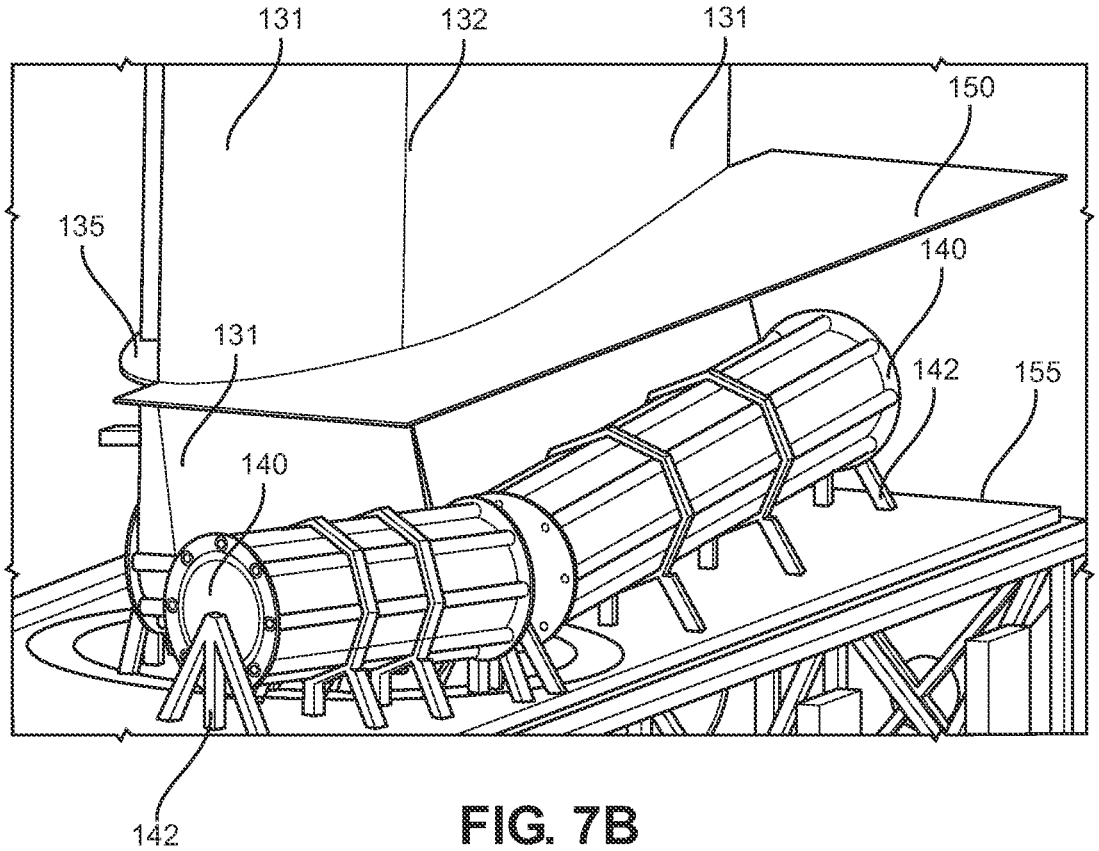
FIG. 7B illustrates in front perspective view an example partial top plate, tape-spring, and spooling arrangement for a self-deploying aerodynamic system according to one embodiment of the present disclosure.

Next, FIGS. 7A and 7B illustrate in varying front perspective views example partial top plate, spar, tape-spring, and internal and external spooling arrangements for a self-deploying aerodynamic system. Again, an overall self-deploying aerodynamic system can include multiple tape-springs 131 that can extend vertically from and retract onto spooling arrangements of externally located conversion devices 140. Similarly, spars 138 can extend vertically from and retract onto spooling arrangements of internal conversion devices. Each external and internal conversion device 140, 141 can include one or more feet 142 to set the spooling arrangements atop bottom plate 155, as well as one or more external guides 143 to help guide and align the respective tape-spring or spar materials as they are extended from or spooled back onto rotating drums of the spooling arrangements.

In various embodiments, each external and internal conversion device 140, 141 can include a spooling arrangement having a central mandrel of material constrained by rollers, which may include external guides 143, with endcaps on both ends and one or more feet 142 that support the endcaps, rollers, external guides along the length of the conversion device. Each external and internal conversion device 140, 141 (e.g., spool) can be powered by electric motors configured to rotate the spool in forward and backward directions, operation of which can be automated. Some arrangements may include the use of springs or other mechanical energy storage or tensioners to reduce the energy needed to operate the spools or other conversion devices 140, 141 in one or both rotational directions.

As noted above, top plate 150 can include a central opening that can be sized and dimensioned such that horizontally oriented ribs 135 are able to pass therethrough as the aerodynamic structure is vertically extended or retracted. This rib shaped central opening in top plate 150 can also facilitate various functions of some or all of multiple tape-springs 131. In some arrangements, top plate 150 can serve as a retention plate that can facilitate the guidance, alignment, coupling, and decoupling of tape-springs 131 during extension and retraction of the tape-springs. While each individual tape-spring 131 can extend or roll from and retract or roll onto its own separate conversion device 140, it is contemplated that the sides of tape-springs 131 can be joined or coupled together during extension, such as along a vertical seam 132. This can be done along the vertical sides of every tape-spring 131, such that there can be vertical seams that couple the tape-springs together at both lateral sides, the front edge, and the back edge of the overall wingsail collectively formed by all tape-springs.

Top plate 150 can be arranged such that each tape-spring 131 passes through a narrow gap between the inner edge of the central opening within the top plate and the outer edges of the various horizontally oriented ribs 135 extending upward through the central opening during deployment to an extended configuration. Various features along top plate 150, the ribs 135, and/or the tape-springs 131 themselves can serve to guide the extending tape-spring material against the ribs, join or couple tape-springs 131 together along their side edges, and/or constrain the wingsail formed by the joined tape-springs against lateral loads.

In various embodiments, each of tape-springs 131 can be formed from a metallic, composite, or laminate material having a thickness of about 2 mm, although other materials and thicknesses are also possible. Each spar 138 can similarly be formed from the same or a similar material having the same or similar thickness as the tape-springs 131. When extended and coupled together side by side, tape-springs 131 can combine to form a vertically oriented enclosed wingsail having a height of about 60 meters, a length of about 8 meters, and a width of about 2 meters when the aerodynamic structure is in a fully extended configuration. Other intermediate extension heights between zero and full extension are also possible, and other dimensions for full height extension, length, and width are also possible for a given wingsail or other aerodynamic structure.

Although the present disclosure has focused primarily on the use of tape-springs to form a vertically oriented wingsail as an aerodynamic structure and spooling arrangements to deploy, retract, and store the tape-springs, it will be readily appreciated that other types of materials, structures, and arrangements are also possible. For example, a wingsail or other suitable aerodynamic structure can be formed from curved sheets or panels that can be stacked in a stored configuration and then rapidly assembled, coupled to rib sections, and stitched together with a zipper mechanism or other coupling arrangement to form the wingsail during deployment.

Figure 8A:
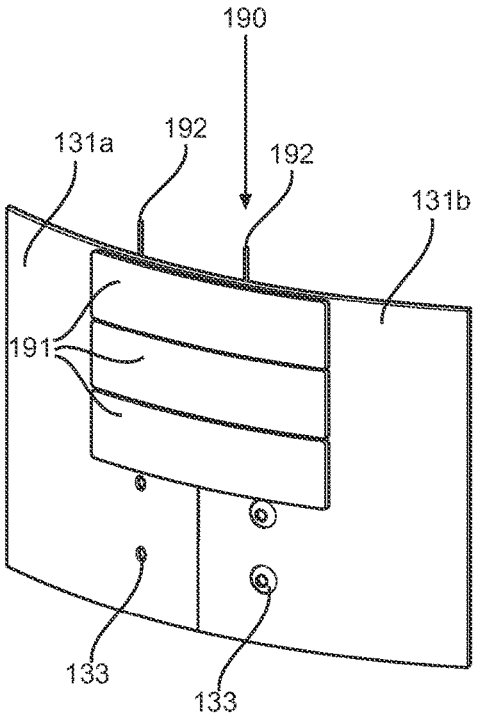
FIG. 8A illustrates in front perspective view an example zipper mechanism for attaching extended tape-springs of a self-deploying aerodynamic system according to one embodiment of the present disclosure.
Figure 8B:
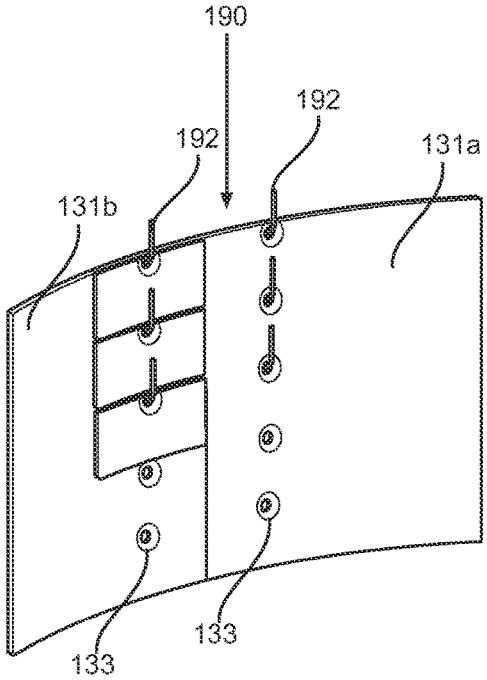
FIG. 8B illustrates in rear perspective view the zipper mechanism of FIG. 8A according to one embodiment of the present disclosure.
Figure 8C:
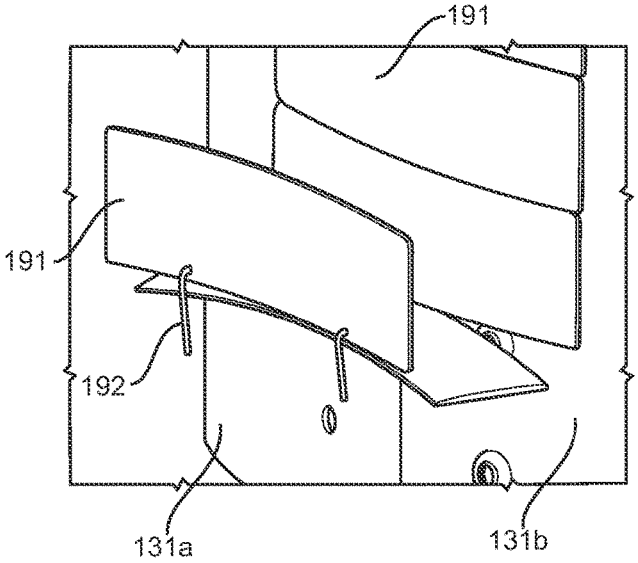
FIG. 8C illustrates in front perspective view actuation of the zipper mechanism of FIG. 8A according to one embodiment of the present disclosure.
Figure 8D:
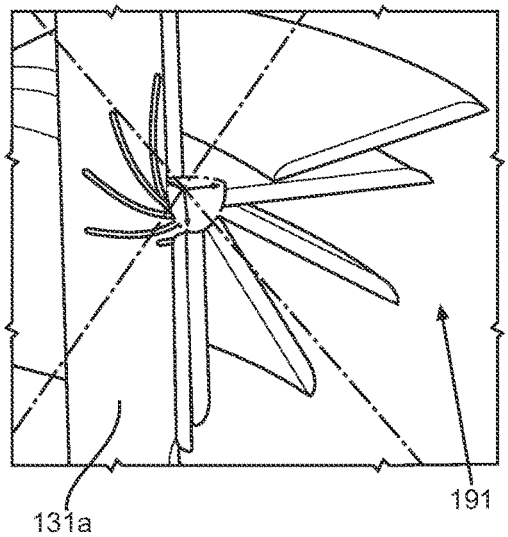
FIG. 8D illustrates in side perspective view actuation of the zipper mechanism of FIG. 8A according to one embodiment of the present disclosure.

Tape-springs 131 can be joined or otherwise coupled lengthwise during deployment and uncoupled during retraction in any of a variety of suitable ways, such as by using a zipper mechanism, for example. FIGS. 8A and 8B depict an example zipper mechanism for attaching extended tape-springs of a self-deploying aerodynamic system in front and rear perspective views respectively, while FIGS. 8C and 8D show the zipper mechanism being actuated in front and side perspective views respectively. Zipper mechanism 190 can be used to automatically couple tape-spring 131*a* to tape-spring 131*b* along the vertical sides of the tape-springs. Each tape-spring 131*a*, 131*b* can have a series of holes 133 along its vertical side to be coupled. Zipper mechanism 190 can have a plurality of zipper segments 191, each of which can have curved segment hooks 192 extending therefrom. Segment hooks 192 can be sized and dimensioned such that these hooks insert into openings 133 on both of tape-springs 131*a*, 131*b* so that each zipper segment 191 can thereby couple the tape-springs together at its location.

In some arrangements, zipper segments 191 can be separate from each other, while other arrangements can involve these zipper segments being coupled together in series, such as by using one or more cables, threads, or other couplers or connectors. Each zipper segment 191, which can be about 1 inch tall by about 4 inches wide, for example, can be used to couple side by side tape-springs 131*a*, 131*b* by pivoting the zipper segment upward as shown in FIG. 8C to insert its segment hooks 192 into corresponding openings 133 on both tape-springs and then pivoting the zipper segment downward to push the hooks through the openings and lay the zipper segment flat against both tape-springs, as reflected by FIG. 8D. Zipper mechanisms 190 can be stored along top plate 150 at the locations of seams 132, for example, and the top plate can include features to help mechanically administer and apply zipper segments 191 to the tape-springs 131*a*, 131*b* as the tape-springs pass by the top plate. As will be readily appreciated, zipper mechanism 190 can be mechanically operated in reverse during retraction so as to separate the tape-springs for separate respooling.

Other coupling mechanisms and arrangements can also or alternatively be used to couple and uncouple tape-springs to each other automatically during deployment and retraction. For example, one tape-spring can have mechanical hooks extending from one vertical side while an adjacent tape-spring can have mechanical openings along its adjacent vertical side, such that the hooks can mate with the openings as both tape-springs come together at and pass through the central opening of top plate 150 between the top plate and ribs. Retraction can then remove the hooks from the openings as they pass back through top plate 150 to thereby decouple the tape-springs from each other during roll up back onto their respective spooling arrangements. Other coupling and decoupling arrangements can involve the use of magnets to mate or couple adjacent vertical sides of tape-springs, and still further alternative coupling and decoupling arrangements can also be used.

Figure 9A:
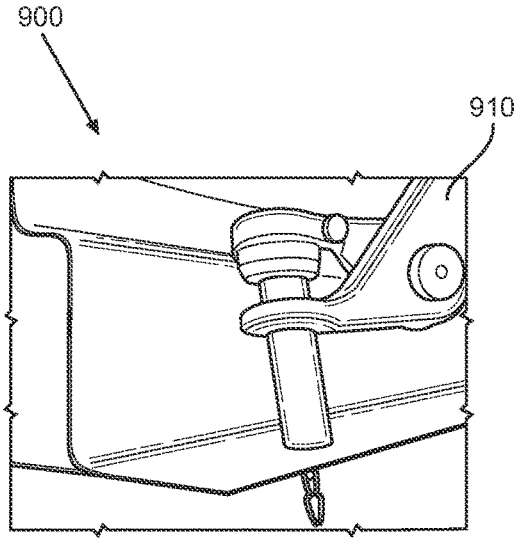
FIG. 9A illustrates in side perspective view an example partial rib to spar fastening arrangement for a self-deploying aerodynamic system according to one embodiment of the present disclosure.
Figure 9B:
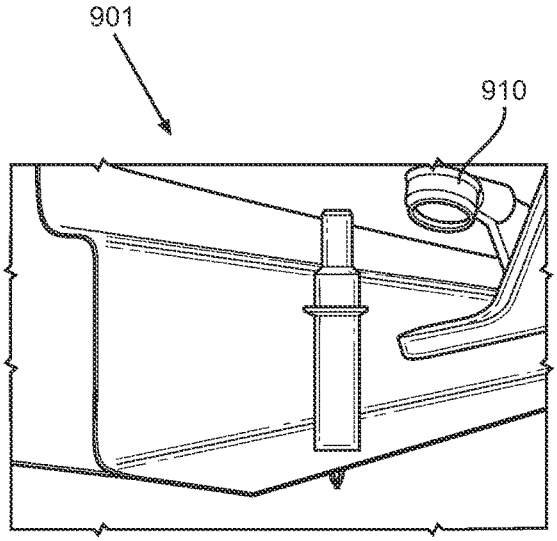
FIG. 9B illustrates in side perspective view an example finished rib to spar fastening arrangement for a self-deploying aerodynamic system according to one embodiment of the present disclosure.
Figure 9C:
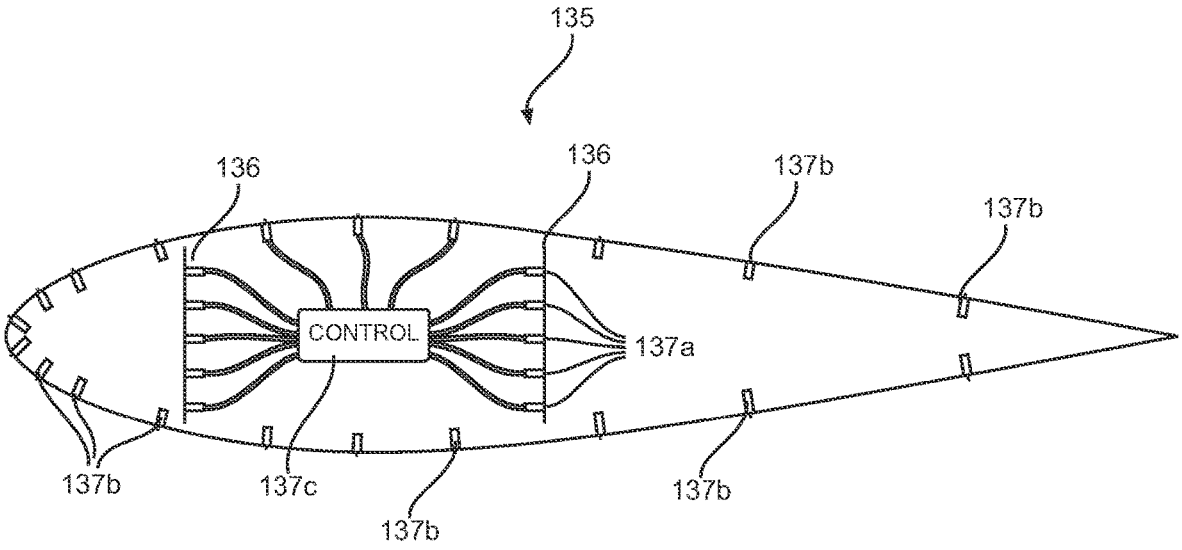
FIG. 9C illustrates in top plan view an example rib with designated rib to spar fastening locations for a self-deploying aerodynamic system according to one embodiment of the present disclosure.

FIGS. 9A and 9B illustrate in side perspective views example partial and finished rib to spar fastening arrangements for a self-deploying aerodynamic system, while FIG. 9C depicts in top plan view an example rib with designated rib to spar and rib to tape-spring fastening locations for a self-deploying aerodynamic system. As noted above, each horizontally oriented rib can be configured to temporarily attach or couple to multiple spars passing therethrough and multiple tape-springs passing therearound when the rib is properly spaced from another rib directly above or below it. Such temporary rib fastening can be shown as an in-progress or partial rib fastening 900 in FIG. 9A and a finished rib fastening 901 in FIG. 9B. Such temporary fastenings or couplings can be facilitated using "Cleco" style devices 910, for example, which can operate to form temporary and removable rivet type fastenings.

As shown in FIG. 9C, each rib 135 can include multiple fastening locations where temporary rib fastenings can be implemented, such as finished fastening 901. A first set of rib fastening locations 137*a* can be located along both rib slots 136 within the rib 135, and these locations 137*a* can be used to fasten the rib to spars extending through the rib slots. Another set of rib fastening locations 137*b* can be located along the outer circumference of rib 135, and these locations 137*b* can be used to fasten the rib to tape-springs all around the outer circumference. Control system 137*c* can be coupled to each of fastening locations 137*a*, 137*b*, and this control system can be used to facilitate rib fastenings and removal of the rib fastenings at each of the fastening locations. Control system 137*c* can be automated, such as by way of sensors or other inputs that detect when the spacing between consecutive ribs is appropriate, such that fastenings should then be made at a given rib during deployment or rib fastenings should be removed during retraction.

Figure 10:
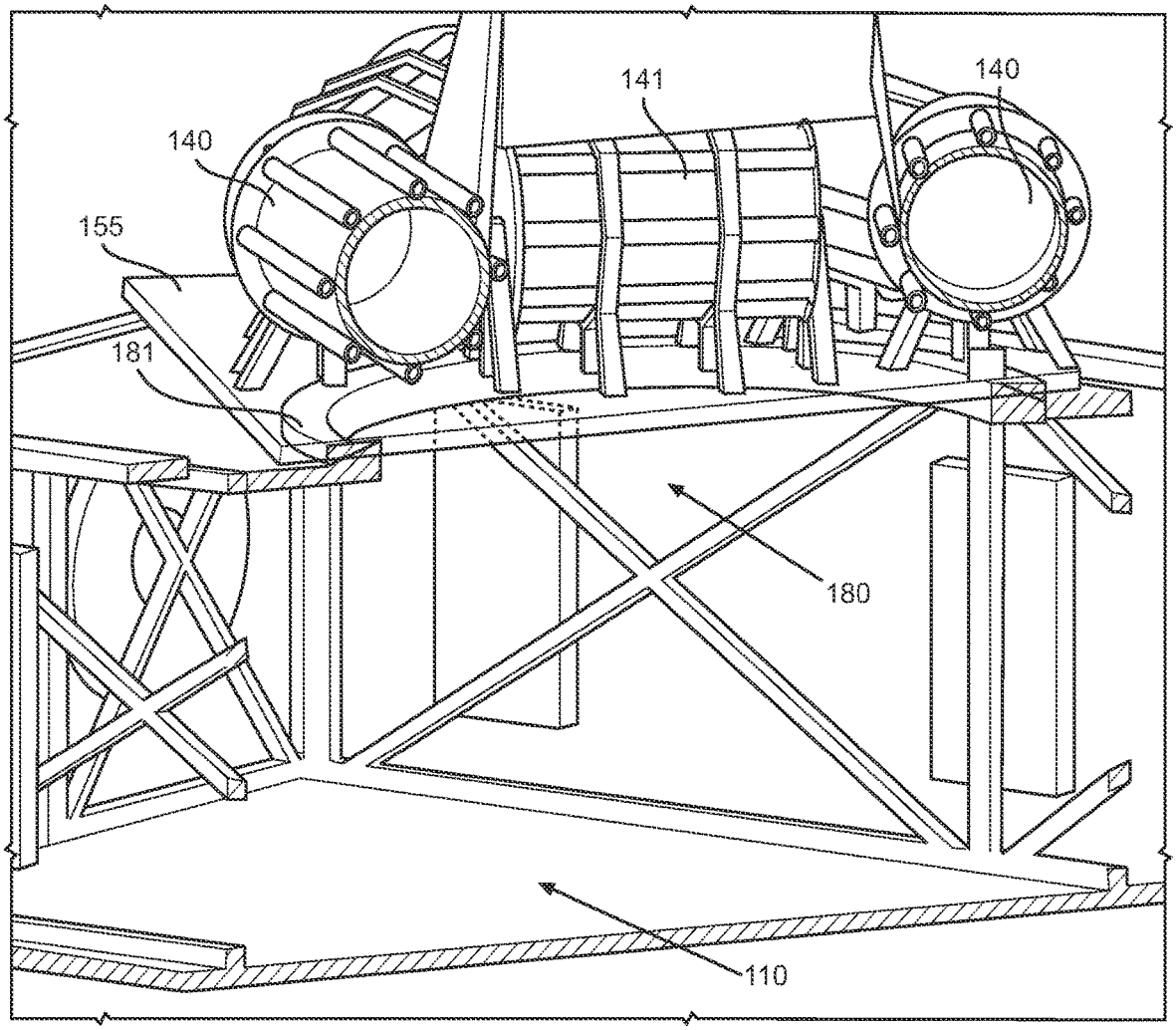
FIG. 10 illustrates in side perspective partial cutaway view a turntable and rotational bearing arrangement for a self-deploying aerodynamic system according to one embodiment of the present disclosure.

FIG. 10 illustrates in side perspective partial cutaway view a turntable and rotational bearing arrangement for a self-deploying aerodynamic system. In various arrangements, turntable arrangement 180 can include a fixed section, a rotating section, a fixed rotational bearing, a moving rotational bearing 181, various bearing materials and features, and a motor configured to drive the moving rotational bearing, among other possible components and features. The fixed section can be the circular stationary component proximate the center of the arrangement, while the rotating section can be the rest of bottom plate 155 rotating around the fixed section.

Figure 11:
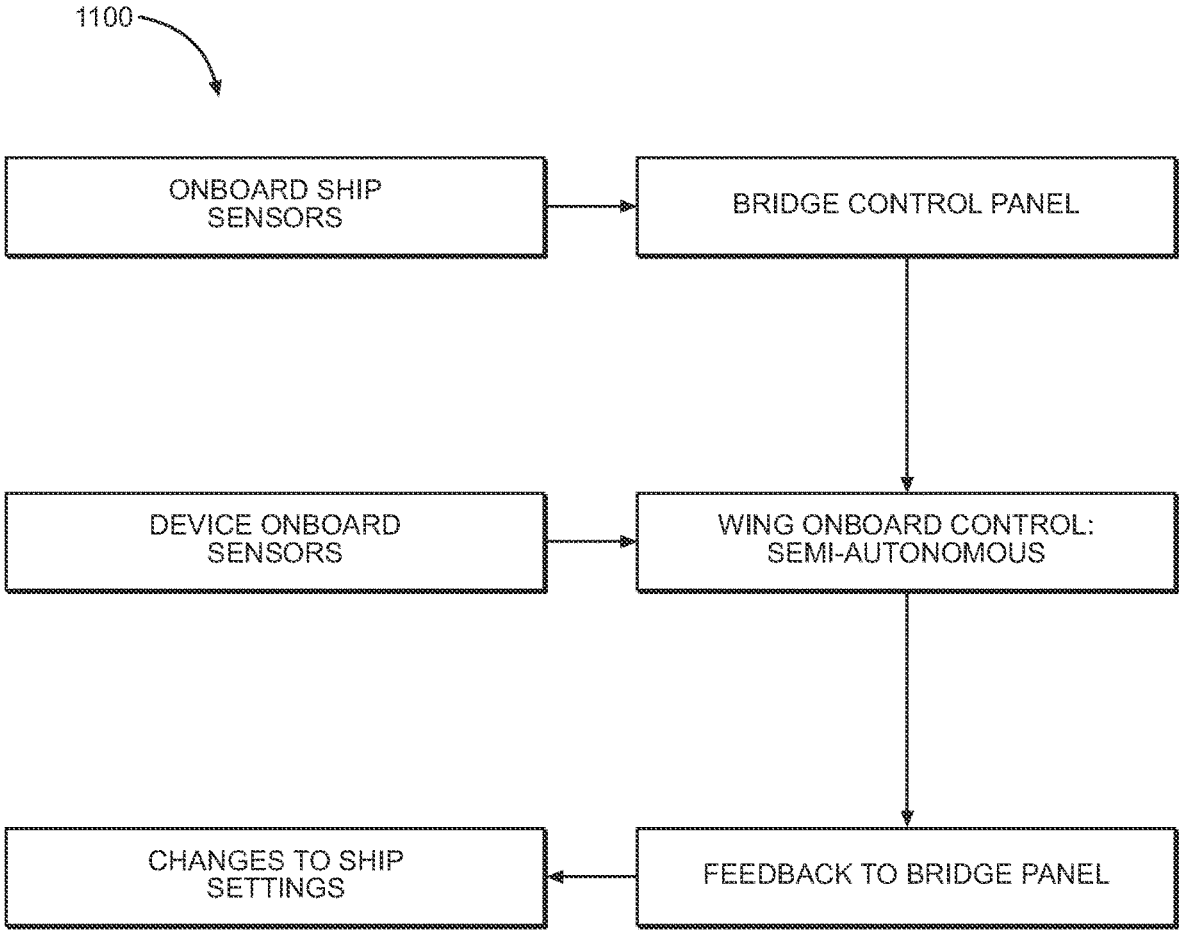
FIG. 11 illustrates a block diagram of an example control system arrangement for a self-deploying aerodynamic system according to one embodiment of the present disclosure.

FIG. 11 illustrates a block diagram of an example control system arrangement for a self-deploying aerodynamic system. Control system arrangement 1100 can include various components and items as shown, each of which can have various relationships with one or more other system components and items. As shown, these can include various sensors, panels, controls, and settings. Other components and items not shown may also be included, and alternative or additional relationships and communication directions may also be added, as will be readily appreciated. In addition, control system arrangement 1100 can reflect an arrangement for a single system or subsystem having one wingsail or other aerodynamic structure that deploys from and retracts to one outer container. For overall systems having multiple such subsystems or units, a global level control system arrangement can be used to couple multiple identical or similar control system arrangements 1100 for each subsystem or unit. Coordination of functions for multiple subsystems or units can then be accomplished using a global level control system arrangement that couples multiple lower level control system arrangements.

Figure 12:
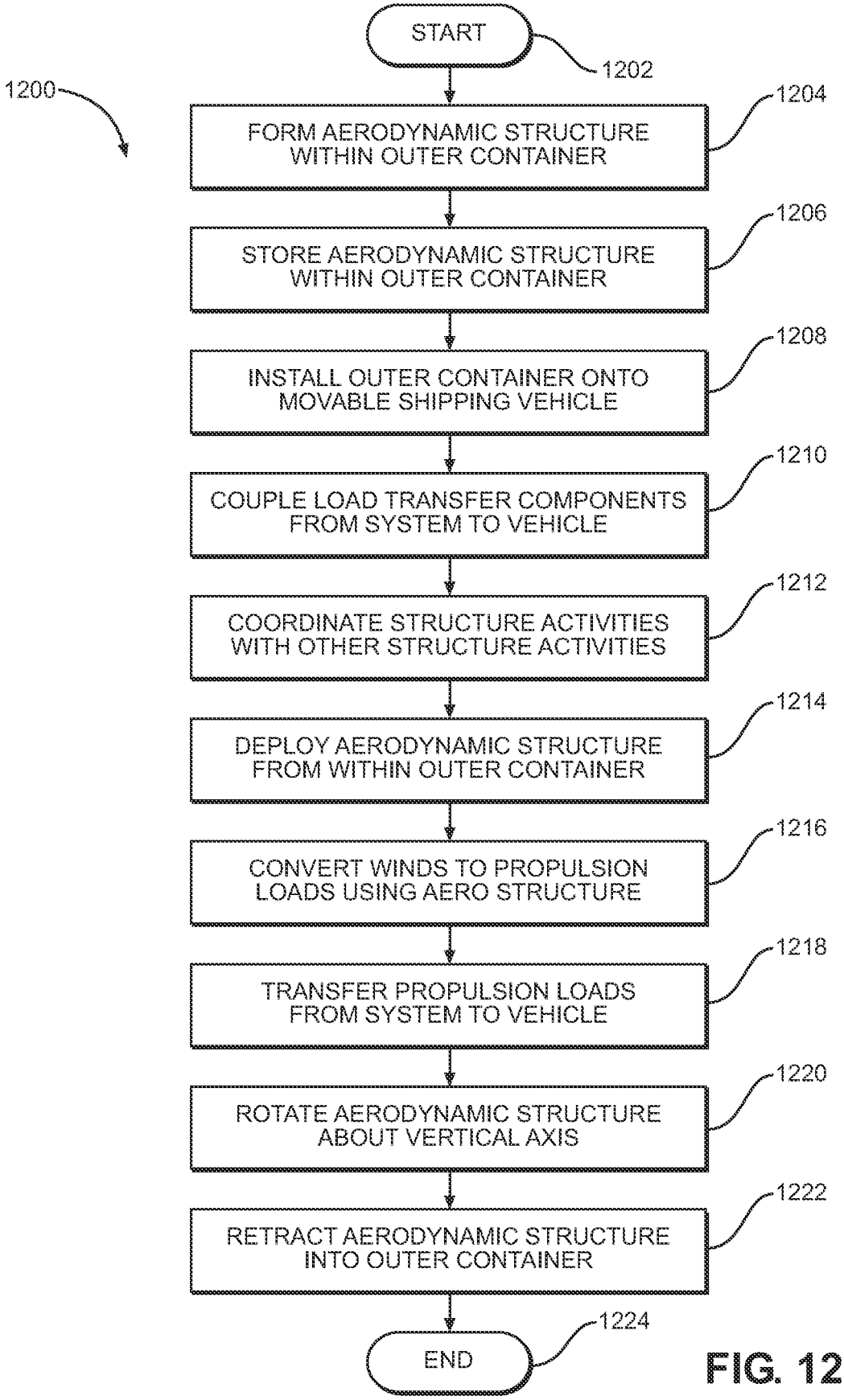
FIG. 12 illustrates a flowchart of an example detailed method of using an aerodynamic structure on a movable shipping vehicle according to one embodiment of the present disclosure.

Lastly, FIG. 12 provides a flowchart of an example detailed method of using an aerodynamic structure on a movable shipping vehicle. Detailed method 1200 can represent one possible way of using an aerodynamic structure on a vehicle, and it will be understood that various other steps, features, and details of such a detailed method are not provided here for purposes of simplicity. After a start step 1202, a first process step 1204 can involve forming an aerodynamic structure within an outer container. This can be a wingsail, for example, such as that which is set forth in detail above. Step 1204 can be manually or automatically performed.

At subsequent process step 1206, the aerodynamic structure can be stored within the outer container. This can be done by keeping the wingsail or other aerodynamic structure in a stored formation within the outer container. The wingsail or other aerodynamic structure and the outer container can be part of an overall self-deploying aerodynamic system, such as that which is set forth in detail above. Step 1206 can be manually or automatically performed.

At the next process step 1208, the outer container can be installed onto a movable shipping vehicle. This can be done by way of a crane placing the outer container atop one or more stacks of shipping containers on a cargo ship, such as that which is shown in FIG. 2A above, for example. Step 1208 can be manually or automatically performed.

At a following process step 1210, one or more load transfer components can be coupled from the system to the vehicle. This can involve extending or unfolding one or more side braces from the sides of outer container such that they brace against adjacent shipping containers or other stable items aboard the vessel or other movable shipping vehicle. Step 1210 can be manually or automatically performed.

At subsequent process step 1212, various activities or actions involving the subject aerodynamic structure can be coordinated with the various activities or actions of other aerodynamic structures within an overall global system on the movable shipping vehicle. For example, deployment and/or retraction of the subject aerodynamic structure can be coordinated with the deployment and/or retraction of one or more other nearby aerodynamic structures such that these structures all deploy or retract together. Step 1212 can be manually or automatically performed, such as where a separate robotic system can be configured to coordinate deployment or retraction activities of multiple aerodynamic structures together.

The next process step 1214 can involve deploying a stored aerodynamic structure from within the outer container, which again can be part of a self-deploying aerodynamic system that includes the aerodynamic structure. The deploying can form an extended aerodynamic structure and can take place while the self-deploying aerodynamic system is installed onto the movable shipping vehicle. Step 1214 can be manually or automatically performed, such as where a separate robotic system can be configured to deploy the stored aerodynamic structure based on a sensed condition or user input.

At a following process step 1216, outside wind forces can be converted to propulsion loads using the extended aerodynamic structure. Step 1216 can be manually or automatically performed, such as where the extended aerodynamic structure is arranged to capture wind and convert the wind forces to propulsion loads due to its wing shape and orientation to the wind.

At the next process step 1218, the propulsion loads can be transferred from the self-deploying aerodynamic system to the movable shipping vehicle. This can result in the propulsion loads being used to at least partially propel the movable shipping vehicle. Step 1218 can be manually or automatically performed, such as where the extended aerodynamic structure is arranged to transfer the propulsion loads through the system to one or more load transfer components in the system which in turn transfer the propulsion loads from the system to one or more load accepting components of the movable shipping vehicle.

Process step 1220 can involve rotating the aerodynamic structure about a vertical axis. This can result in rotating the wingsail or other aerodynamic structure relative to the outer container such that the shape of the aerodynamic structure is advantageously oriented with respect to the current wind conditions around the subject movable shipping vehicle. Step 1220 can be manually or automatically performed, such as where a separate robotic system can be configured to rotate the fully or partially deployed aerodynamic structure based on a sensed condition or user input such as wind speed and direction.

At subsequent process step 1222, the extended aerodynamic structure can be retracted into the outer container of the self-deploying aerodynamic system. This can then reform the stored aerodynamic structure. Step 1222 can be manually or automatically performed, such as where a separate robotic system can be configured to retract the extended aerodynamic structure based on a sensed condition or user input. The method can then end at end step 1224.

For foregoing method 1200, it will be appreciated that not all process steps are necessary, and that other process steps may be added in some arrangements. For example, deploying or retracting the aerodynamic structure to an intermediately extended configuration might take place in some arrangements. Furthermore, the order of steps may be altered in some cases, and some steps may be performed simultaneously. For example, steps 1216 and 1218 may be performed simultaneously in some cases. Although known process steps are provided for the various techniques in method 1200, it will be appreciated that any other suitable similar method for deploying or using a wingsail or other aerodynamic structure can also be used. Other variations and extrapolations of the disclosed methods will also be readily appreciated by those of skill in the art.

Although the foregoing disclosure has been described in detail by way of illustration and example for purposes of clarity and understanding, it will be recognized that the above described disclosure may be embodied in numerous other specific variations and embodiments without departing from the spirit or essential characteristics of the disclosure. Certain changes and modifications may be practiced, and it is understood that the disclosure is not to be limited by the foregoing details, but rather is to be defined by the scope of the appended claims.

What is claimed is:

1. A system configured to self-deploy an aerodynamic structure, the system comprising:

an outer container configured to store the aerodynamic structure therein and deploy the aerodynamic structure therefrom, wherein the outer container has a standardized form factor;

one or more load transfer components located proximate the outer container and configured to transfer propulsion loads from the system to a movable shipping vehicle;

the aerodynamic structure, including one or more wind capturing components configured to convert outside wind forces to propulsion loads and one or more structural components configured to stabilize and space apart the one or more wind capturing components, wherein the aerodynamic structure is configured to be deployed to an extended configuration outside the outer container and to be retracted to a stored configuration within the outer container, and wherein the one or more wind capturing components include multiple vertically oriented tape-springs arranged into the shape of a vertically oriented enclosed wingsail and the one or more structural components include multiple horizontally oriented ribs located within and spaced apart from the top to the bottom of the vertically oriented enclosed wingsail when the aerodynamic structure is in the extended configuration; and one or more conversion devices configured both to deploy automatically the aerodynamic structure from the stored configuration to the extended configuration and to retract automatically the aerodynamic structure from the extended configuration to the stored configuration while the system is removably installed on the movable shipping vehicle.

2. The system of claim 1, wherein the standardized form factor corresponds to the size or footprint of one or more standard cargo shipping containers.

3. The system of claim 1, wherein the system is configured to be removably installed directly atop and coupled to one or more stacks of multiple standard cargo shipping containers located on a top deck of the movable shipping vehicle.

4. The system of claim 1, wherein each of the multiple vertically oriented tape-springs is formed from a metallic material having a thickness of about 2 mm.

5. The system of claim 1, wherein the vertically oriented enclosed wingsail has a height of about 60 meters, a length of about 8 meters, and a width of about 2 meters when the aerodynamic structure is in the extended configuration.

6. The system of claim 1, wherein the spacing between each of the horizontally oriented ribs is about 2 meters when the aerodynamic structure is in the extended configuration.

7. The system of claim 1, wherein the one or more structural components further include one or more vertically arranged spars located between, extending through, and configured to facilitate the spacing of the multiple horizontally oriented ribs when the aerodynamic structure is in the extended configuration.

8. The system of claim 1, wherein the one or more conversion devices include a spooling arrangement for each of the one or more wind capturing components, the spooling arrangement having a rotating drum configured to wrap a wind capturing component thereabout when the aerodynamic structure is in the stored configuration.

9. The system of claim 1, further comprising:

a rotational bearing coupling the aerodynamic structure to the outer container, wherein the rotational bearing is configured to facilitate rotation of the aerodynamic structure about a vertical axis relative to the outer container when the aerodynamic structure is in the extended configuration.

10. The system of claim 1, further comprising:

one or more motors coupled to and configured to facilitate the automated operation of the one or more conversion devices; and one or more rechargeable batteries coupled to and configured to provide power to the one or more motors, wherein the one or more motors and the one or more rechargeable batteries are located within the outer container.

11. The system of claim 1, further comprising:

at least one processor in communication with and configured to facilitate the operations of the one or more conversion devices.

12. A system configured to self-deploy an aerodynamic structure, the system comprising:

an outer container configured to store the aerodynamic structure therein and deploy the aerodynamic structure therefrom, wherein the outer container has a standardized form factor;

one or more load transfer components located proximate the outer container and configured to transfer propulsion loads from the system to a movable shipping vehicle;

the aerodynamic structure, including one or more wind capturing components configured to convert outside wind forces to propulsion loads and one or more structural components configured to stabilize and space apart the one or more wind capturing components, wherein the aerodynamic structure is configured to be deployed to an extended configuration outside the outer container and to be retracted to a stored configuration within the outer container;

one or more conversion devices configured both to deploy automatically the aerodynamic structure from the stored configuration to the extended configuration and to retract automatically the aerodynamic structure from the extended configuration to the stored configuration while the system is removably installed on the movable shipping vehicle;

a top plate located across and covering a top opening of the outer container at a top plate storage position when the aerodynamic structure is in the stored configuration inside the outer container, wherein the top plate is configured to elevate from the top plate storage position to a top plate extended position when the aerodynamic structure is in the extended configuration; and a bottom plate located proximate the bottom of the outer container at a bottom plate storage position when the aerodynamic structure is in the stored configuration inside the outer container, wherein the bottom plate is configured to elevate from the bottom plate storage position to a bottom plate extended position proximate the top opening of the storage container when the aerodynamic structure is in the extended configuration.

13. The system of claim 12, wherein the top plate includes one or more features configured to guide the extension and the retraction of the one or more wind capturing components.

14. The system of claim 12, wherein the one or more wind capturing components include multiple vertically oriented tape-springs arranged into the shape of a vertically oriented enclosed wingsail and the one or more structural components include multiple horizontally oriented ribs located within and spaced apart from the top to the bottom of the vertically oriented enclosed wingsail when the aerodynamic structure is in the extended configuration.

15. The system of claim 12, wherein the one or more conversion devices include a spooling arrangement for each of the one or more wind capturing components, the spooling arrangement having a rotating drum configured to wrap a wind capturing component thereabout when the aerodynamic structure is in the stored configuration.

16. The system of claim 12, further comprising:

a rotational bearing coupling the aerodynamic structure to the outer container, wherein the rotational bearing is configured to facilitate rotation of the aerodynamic structure about a vertical axis relative to the outer container when the aerodynamic structure is in the extended configuration.

17. The system of claim 12, further comprising:

one or more motors coupled to and configured to facilitate the automated operation of the one or more conversion devices; and one or more rechargeable batteries coupled to and configured to provide power to the one or more motors, wherein the one or more motors and the one or more rechargeable batteries are located within the outer container.

18. A method of using an aerodynamic structure on a movable shipping vehicle, the method comprising:

deploying automatically a stored aerodynamic structure from within an outer container of a self-deploying aerodynamic system to form an extended aerodynamic structure while the self-deploying aerodynamic system is installed onto a movable shipping vehicle, wherein the extended aerodynamic structure includes multiple vertically oriented tape-springs arranged into the shape of a vertically oriented enclosed wingsail and multiple horizontally oriented ribs located within and spaced apart from the top to the bottom of the vertically oriented enclosed wingsail;

converting automatically outside wind forces to propulsion loads using the extended aerodynamic structure;

transferring automatically the propulsion loads from the self-deploying aerodynamic system to the movable shipping vehicle, wherein the propulsion loads are used to at least partially propel the movable shipping vehicle; and retracting automatically the extended aerodynamic structure into the outer container of the self-deploying aerodynamic system to reform the stored aerodynamic structure.

19. The method of claim 18, further comprising the steps of:

rotating automatically the extended aerodynamic structure about a vertical axis relative to the outer container from a first rotational position to a second rotational position, wherein rotating to the second rotational position results in improved conversion of the outside wind forces to propulsion loads.

20. The method of claim 18, further comprising the steps of:

forming the stored aerodynamic structure within the outer container of the self-deploying aerodynamic system;

storing the stored aerodynamic structure within the outer container of the self-deploying aerodynamic system;

installing the self-deploying aerodynamic system onto one or more standard cargo shipping containers located on the movable shipping vehicle;

coupling one or more load transfer components of the self-deploying aerodynamic system to one or more load receiving components located on the movable shipping vehicle; and coordinating the deploying and retracting of the aerodynamic structure with the use of one or more separate aerodynamic structures on the movable shipping vehicle.

* * * * *